US009159253B2

(12) United States Patent
Wang

(10) Patent No.: US 9,159,253 B2
(45) Date of Patent: Oct. 13, 2015

(54) LIGHTING DISPLAY HAVING ANIMATED EFFECT

(76) Inventor: Jessica Wang, Taipei (TW)

( * ) Notice: Subject to any disclaimer, the term of this patent is extended or adjusted under 35 U.S.C. 154(b) by 781 days.

(21) Appl. No.: 12/611,839

(22) Filed: Nov. 3, 2009

(65) Prior Publication Data

US 2011/0101873 A1 May 5, 2011

(51) Int. Cl.

| | |
|---|---|
| ***F21S 4/00*** | (2006.01) |
| ***G09F 13/28*** | (2006.01) |
| ***G09F 19/12*** | (2006.01) |
| ***H05B 33/08*** | (2006.01) |
| *F21W 121/00* | (2006.01) |

(52) U.S. Cl.

CPC ..... *G09F 13/28* (2013.01); *F21S 4/001* (2013.01); *G09F 19/12* (2013.01); *H05B 33/0842* (2013.01); *H05B 33/0857* (2013.01); *F21W 2121/00* (2013.01)

(58) Field of Classification Search

CPC ..... F21S 4/001
USPC ..... 362/223, 224, 249.01–249.19
See application file for complete search history.

(56) References Cited

U.S. PATENT DOCUMENTS

| | | | | |
|---|---|---|---|---|
| 1,589,018 | A | | 6/1926 | Ludwig |
| 1,684,922 | A | | 9/1928 | Mammen |
| 1,902,991 | A | | 3/1933 | Cardon |
| 2,191,041 | A | | 2/1940 | Protz ..... 41/10 |
| 3,400,263 | A | | 9/1968 | Yakim ..... 240/10 |
| 3,694,648 | A | | 9/1972 | Yates ..... 240/10 T |
| 4,060,722 | A | | 11/1977 | Foley ..... 362/32 |
| 4,228,486 | A | | 10/1980 | Matsuya ..... 362/237 |
| 4,339,787 | A | | 7/1982 | Burnbaum ..... 362/121 |
| 4,364,102 | A | | 12/1982 | Huppert et al. ..... 362/123 |
| 4,462,065 | A | | 7/1984 | Rhodes ..... 362/250 |
| 4,713,586 | A | | 12/1987 | Chiang ..... 315/200 A |
| 4,885,664 | A | | 12/1989 | Hermanson ..... 362/123 |
| 4,992,914 | A | | 2/1991 | Heiss et al. ..... 362/153.1 |
| 5,104,608 | A | | 4/1992 | Pickering ..... 362/32 |
| 5,150,964 | A | | 9/1992 | Tsui ..... 362/251 |
| 5,233,680 | A | | 8/1993 | Fussell ..... 392/390 |
| 5,250,331 | A | | 10/1993 | Grefalda ..... 428/11 |
| 5,379,202 | A | * | 1/1995 | Daun ..... 362/249.16 |
| 5,396,408 | A | | 3/1995 | Szczech, III ..... 362/397 |
| 5,517,390 | A | | 5/1996 | Zins ..... 362/123 |
| 5,566,483 | A | | 10/1996 | Ogren ..... 40/564 |
| 5,577,831 | A | | 11/1996 | Chang ..... 362/240 |

(Continued)

OTHER PUBLICATIONS

Longwood Gardens—Seasonal Festivals—2000 Christmas, URL=http://www.longwoodgardens.org/SeasonalFestivals/Christmas/2000christmas.htm, download date Nov. 23, 2000, p. 5.

(Continued)

*Primary Examiner* — Thomas A Hollweg
*Assistant Examiner* — Christopher Raabe
(74) *Attorney, Agent, or Firm* — Seed IP Law Group PLLC

(57) ABSTRACT

A decorative lighting display including at least one string of lighting elements positioned within a display housing having a plurality of distinct regions, and wherein, when the lighting display is activated, one or more lighting elements positioned in a first region of the housing intermittingly illuminate a first portion of the display and one or more lighting elements positioned in a second region intermittingly illuminate a second portion of the display, the intermittent illumination of the first and second portions of the display cooperating to produce a dynamic or animated visual effect.

36 Claims, 13 Drawing Sheets

(56) References Cited

U.S. PATENT DOCUMENTS

| | | | | |
|---|---|---|---|---|
| 5,645,343 | A | 7/1997 | Rinehimer | 362/252 |
| 5,772,312 | A | 6/1998 | Pihl-Niederman et al. | 362/249 |
| 5,780,965 | A * | 7/1998 | Cass et al. | 313/506 |
| D397,957 | S * | 9/1998 | Lee | D11/121 |
| 5,828,183 | A | 10/1998 | Wang et al. | 315/185.5 |
| 5,850,927 | A | 12/1998 | Pan | 211/181.1 |
| 5,915,827 | A | 6/1999 | Wang | 362/252 |
| 5,955,156 | A | 9/1999 | Hermanson | 428/7 |
| 6,001,435 | A | 12/1999 | Hardy et al. | 428/18 |
| 6,164,793 | A | 12/2000 | Wu | 362/101 |
| 6,284,330 | B1 | 9/2001 | Hermanson | 428/9 |
| 6,318,882 | B1 | 11/2001 | Chang | 362/252 |
| 6,329,028 | B1 | 12/2001 | Bucher | 428/18 |
| 6,352,355 | B1 | 3/2002 | Law | 362/253 |
| 6,394,282 | B1 | 5/2002 | Pan | 211/1.51 |
| 6,402,336 | B1 * | 6/2002 | Reese | 362/103 |
| 6,413,594 | B1 | 7/2002 | Onishi | 428/7 |
| 6,443,593 | B1 * | 9/2002 | Lauschner | 362/239 |
| 6,478,164 | B1 | 11/2002 | Pan | 211/1.51 |
| 6,526,681 | B1 | 3/2003 | De Saro | 40/564 |
| 6,561,674 | B2 | 5/2003 | Gibboney, Jr. | 362/253 |
| 6,652,927 | B1 | 11/2003 | Chen | 428/7 |
| 6,719,440 | B1 | 4/2004 | Wang | 362/249 |
| 6,769,954 | B2 | 8/2004 | Su | 446/353 |
| 6,783,259 | B1 * | 8/2004 | Macedonio | 362/249.12 |
| 6,830,361 | B2 | 12/2004 | Wang | 362/249 |
| 6,854,863 | B2 | 2/2005 | Wu | 362/292 |
| 6,905,229 | B2 | 6/2005 | Fan | 362/252 |
| 7,086,757 | B2 | 8/2006 | Wang | 362/249 |
| 7,303,312 | B2 | 12/2007 | Wang | 362/252 |
| 7,585,091 | B2 | 9/2009 | Wang | 362/249.14 |
| 2002/0121295 | A1 | 9/2002 | Chen et al. | 135/16 |
| 2003/0137841 | A1 * | 7/2003 | Wu | 362/252 |
| 2003/0156405 | A1 | 8/2003 | Kim | 362/153.1 |
| 2003/0184829 | A1 | 10/2003 | Odhner et al. | 359/15 |
| 2003/0214809 | A1 | 11/2003 | Wong | 362/249 |
| 2004/0042220 | A1 * | 3/2004 | Liou | 362/391 |
| 2004/0100797 | A1 | 5/2004 | Yang | 362/252 |
| 2004/0125594 | A1 | 7/2004 | Wu | 362/101 |
| 2005/0047136 | A1 * | 3/2005 | Fan | 362/252 |
| 2005/0105288 | A1 | 5/2005 | Chen | 362/249 |
| 2006/0158888 | A1 * | 7/2006 | Wang | 362/351 |
| 2006/0171147 | A1 * | 8/2006 | Day | 362/249 |
| 2006/0274526 | A1 | 12/2006 | Weston et al. | 362/252 |
| 2007/0097685 | A1 * | 5/2007 | Gan | 362/252 |
| 2007/0217186 | A1 | 9/2007 | Liao | 362/147 |
| 2008/0143653 | A1 * | 6/2008 | Shishido | 345/78 |
| 2008/0291676 | A1 * | 11/2008 | Keneman | 362/249 |

OTHER PUBLICATIONS

ChristmasDepot.com—Outdoor Decorations Topiary Sculptures Menu, URL=http://web.archive.org/web/20020117044252/www.christmaspromotions.com/menu.cgi?S=Outdo . . . , archived as of Jan. 17, 2002.

ChristmasDepot.com—Christmas—Outdoor Decorations—Topiary Sculptures—Standing Deer—3 . . . , URL=http://web.archive.org/web/20020118074543/www.christmaspromotions.com/prod.cgi?6904, archived as of Jan. 18, 2002.

ChristmasLights, Etc.—christmas lights, pre-lit artificial christmas trees, outdoor decorations, URL=http://web.archive.org/web/20020121032518/http://www.christmaslightsetc.com/, archived as of Jan. 21, 2002.

Christmas Holiday Decorations by Brite Star, URL=http://web.archive.org/web/20010708003923/www.britestar.com/products.ASP?PID=1620&SID= . . . , archived as of Jul. 8, 2001.

Photographs taken on Nov. 16, 2005, Magicolor 100 Light String Set, Magicolor, Inc., Arlington, Texas, first sold Apr. 13, 2001.

* cited by examiner

LIGHTING DISPLAY HAVING ANIMATED EFFECT

BACKGROUND

1. Technical Field

This disclosure relates generally to decorative lighting displays, and more particularly, to decorative lighting displays having a dynamic or animated visual effect.

2. Description of the Related Art

Many different designs of ornaments and lighting displays have been developed for decorating during particular holidays or festive occasions. Some such lighting displays include formed lighting fixtures having lights distributed over a skeletal structure to illuminate in a static manner. For example, embodiments of various formed lighting fixtures are described in U.S. Pat. No. 7,086,757, incorporated herein by reference in its entirety.

Other lighting displays have been developed that include mechanical means to move portions of the display through a series of positions to create an animated effect. Such mechanically driven lighting displays are relatively complex and are prone to mechanical wear.

BRIEF SUMMARY

According to various embodiments, a decorative lighting display is provided that is configured to produce a dynamic or animated visual effect. The decorative lighting display includes a first string of lighting elements terminating in an electrical plug positioned within a display housing having a plurality of distinct regions or compartments. The string of lighting elements includes at least a first group and a second group of lighting elements, the lighting elements within each group being connected to each other in series by one or more conductors to illuminate simultaneously when energized and being positioned within the housing such that one or more of the lighting elements of the first group is/are positioned in a first region of the housing and one or more of the lighting elements of the second group is/are positioned in a second region of the housing separate from the first region. When the lighting display is activated, the one or more lighting elements positioned in the first region intermittingly illuminate a first portion of the display and the one or more lighting elements positioned in the second region intermittingly illuminate a second portion of the display, the intermittent illumination of the first and second portions of the display cooperating to produce a dynamic or animated visual effect. The string of lighting elements may include a controller configured to illuminate the first and second groups of lighting elements alternately. The lighting display may further include a second string of lighting elements terminating in an electrical plug wherein one or more of the lighting elements of the second string is/are positioned in a third region separate from the lighting elements of the first string and wherein the lighting elements are configured to constantly illuminate a third portion of the display when the lighting display is activated. The display housing may be a one-piece plastic molded housing that includes one or more projections extending from a lower surface to partition the housing into the plurality of regions. The housing may be an open-ended frame, the frame including one or more partition members for dividing the housing into the plurality of regions. The housing may be partitioned such that, when the lighting display is activated, light emanating from one of the regions is substantially prevented from illuminating any other region.

The lighting display may further include a first multi-layered display panel coupled to the housing and having at least an image layer, the image layer including at least a first area of relatively high transmissivity and containing a decorative image, and wherein, when the lighting display is activated, the one or more lighting elements positioned in the first region intermittingly illuminate a first portion of the decorative image and the one or more lighting elements positioned in the second region intermittingly illuminate a second portion of the decorative image, the intermittent illumination of the first and second portions of the decorative image cooperating to produce an animated visual effect. The first display panel may further include an outer layer, the outer layer comprising at least a first and a second display area having a relatively high and relatively low transmissivity, respectively, and wherein the first display area is aligned with at least a portion of the decorative image and the second display area surrounds at least a portion of the decorative image. The second display area may be at least substantially opaque. The outer layer may further include a third display area having a relatively moderate transmissivity, the third display area aligned with the first portion of the decorative image such that, when the display is inactive, the first portion of the decorative image has a relatively darker appearance than the portion of the decorative image underlying the first display area. A portion of a thickness of the image layer may be configured to diffract and/or refract light passing therethrough. The image layer may be a single plastic sheet having a smooth surface and a textured opposing surface. The decorative image may include a plurality of design elements of varying shape and color and be integrally formed in the plastic sheet. The housing may include a substantially flat outer surface for receiving the display panel such that a viewing surface of the lighting display is substantially two-dimensional, or may include a curved outer surface for receiving the display panel such that a viewing surface of the lighting display is three-dimensional.

The lighting display may further include a second multi-layered display panel coupled to the housing opposite the first multi-layered display panel such that, when the lighting display is activated, the one or more lighting elements positioned in the first region intermittingly illuminate a first portion of the decorative image on the first display panel and a first corresponding portion of a corresponding decorative image on the second display panel and the one or more lighting elements positioned in the second region intermittingly illuminate a second portion of the decorative image on the first display panel and a second corresponding portion of the corresponding decorative image on the second display panel, the intermittent illumination of the first and second portions of the decorative image of the first display panel and the corresponding first and second portions of the corresponding decorative image of the second display panel cooperating to produce an animated visual effect on opposing sides of the housing.

In other embodiments, a decorative lighting display is provided, the display including a housing having one or more partitions to divide the housing into a plurality of distinct regions; a first string of lighting elements terminating in an electrical plug coupled to the housing with one or more lighting elements positioned in a first region of the housing and one or more lighting elements positioned in a second region of the housing; and a first display panel coupled to the housing and having at least an image layer, the image layer containing a decorative image and being formed of a single plastic sheet wherein at least a portion of a thickness of the sheet is configured to diffract light passing therethrough. When the lighting display is activated, the one or more lighting elements positioned in the first region of the housing intermittingly illuminate a first portion of the decorative image and the one or more lighting elements positioned in the second region of the housing intermittingly illuminate a second portion of the decorative image, the intermittent illumination of the first and second portions of the decorative image cooperating to produce an animated visual effect. The lighting display may include a second string of lighting elements, one or more of the lighting elements of the second string positioned in a third region of the housing separate from the lighting elements of the first string and configured to constantly illuminate a third portion of the decorative image when the lighting display is activated. The first display panel may comprise more than one layer and may include an outer layer, the outer layer comprising at least a first and a second display area having a relatively high and relatively low transmissivity, respectively, and wherein the first display area is aligned with at least a portion of the decorative image and the second display area surrounds at least a portion of the decorative image. The plurality of regions of the housing may be partitioned such that, when the lighting display is activated, light emanating from one of the regions is substantially prevented from illuminating any other region.

The lighting display may further include a second display panel coupled to the housing opposite the first display panel such that, when the lighting display is activated, the one or more lighting elements positioned in the first region intermittingly illuminate a first portion of the decorative image on the first display panel and a first corresponding portion of a corresponding decorative image on the second display panel and the one or more lighting elements positioned in the second region intermittingly illuminate a second portion of the decorative image on the first display panel and a second corresponding portion of the corresponding decorative image on the second display panel, the intermittent illumination of the first and second portions of the decorative image of the first display panel and the corresponding first and second portions of the corresponding decorative image of the second display panel cooperating to produce an animated visual effect on opposing sides of the housing.

In other embodiments, a method for making a lighting display is provided, the method including providing a housing having a plurality of distinct regions, including at least a first region and a second region; and positioning at least a portion of each of a first and a second group of lighting elements of a first light string in the first and second regions, respectively, the lighting elements within each group connected to each other in series by one or more conductors to illuminate simultaneously when energized and being configured such that, when the lighting display is activated, the one or more lighting elements contained in the first region intermittingly illuminate a first portion of the display and the one or more lighting elements contained in the second region intermittingly illuminate a second portion of the display to produce a dynamic or animated visual effect. The method may further include coupling at least a portion of a third group of lighting elements that are connected to each other to illuminate simultaneously when energized to a third region of the housing that is distinct from the first and second regions such that, when the display is activated, one or more lighting elements contained in the third region constantly illuminates a third portion of the display while being substantially shielded from illuminating the first or second portions of the display. The method may further include coupling a first display panel having a decorative image formed therein to the housing with a first portion of the decorative image aligned with the first region and a second portion of the image aligned with the second region such that, when the lighting display is activated, the one or more lighting elements contained in the first region intermittingly illuminate the first portion of the decorative image and the one or more lighting elements contained in the second region intermittingly illuminate the second portion of the decorative image to produce an animated visual effect. The first display panel may include an image layer coupled to an outer layer, the image layer having at least a first area of relatively high transmissivity and containing the decorative image, and the outer layer including at least a first display area of relatively high transmissivity aligned with a portion of the decorative image and a second display area that is substantially opaque surrounding at least a portion of the decorative image. The method may further include coupling a second display panel having a corresponding decorative image formed therein to the housing opposite the first display panel, a first corresponding portion of the corresponding decorative image aligned with the first region and a second corresponding portion of the corresponding decorative image aligned with the second region such that, when the lighting display is activated, the one or more lighting elements contained in the first region intermittingly illuminate the first portion of the decorative image and the first corresponding portion of the corresponding decorative image and the one or more lighting elements contained in the second region intermittingly illuminate the second portion of the decorative image and the second corresponding portion of the corresponding decorative image to produce an animated visual effect on opposing sides of the housing.

In yet other embodiments, a three-dimensional decorative lighting display is provided, the display including a first display panel forming at least a portion of an exterior surface of the three-dimensional display and a first string of lighting elements coupled to the display, the string terminating in an electrical plug and including a first group of lighting elements positioned within the display behind a first portion of the display panel and a second group of lighting elements of the string positioned within the display behind a second portion of the display panel separate from the first portion, each of the first and second groups of lighting elements configured to illuminate simultaneously when activated. When the lighting display is activated, each of the first and second groups of lighting elements intermittingly illuminate at least a part of a decorative image formed in the first and second portions of the display panel, respectively. The first string of lighting elements may include a controller configured to illuminate the first and second groups of lighting elements alternately. The display panel may include an outer layer, the outer layer comprising at least a first and a second area having a relatively high and relatively low transmissivity, respectively, and wherein the first area is aligned with a first decorative image formed in the first portion of the display panel and the second area surrounds the first decorative image. The lighting display may further include a second display panel forming an opposing portion of the exterior surface of the three-dimensional display such that, when the lighting display is activated, the intermittent illumination of one or more parts of each of the first and second display panels cooperate to produce an animated visual effect on opposing sides of the display.

In yet other embodiments, a decorative lighting display is provided, the display including a three-dimensional housing having an interior cavity partitioned into a plurality of compartments and a string of lighting elements coupled to the housing, the string terminating in an electrical plug and including at least a first group of lighting elements and a second group of lighting elements, the first group of lighting elements positioned within the housing in a first compartment and the second group of lighting elements positioned within the housing in a second compartment. When the lighting display is activated, each of the first and second groups of lighting elements intermittingly illuminate at least a portion of the housing overlying the first and second compartments, respectively. The string of lighting elements may include at least three groups of lighting elements positioned in the first compartment, the second compartment and a third compartment, respectfully, the lighting elements within each group being connected to each other in series by one or more conductors to illuminate simultaneously when energized, and wherein the display further comprises a controller coupled to the string, the controller configured to illuminate each of the groups of lighting elements intermittingly to produce a dynamic visual effect. The housing may include a first shell structure and a second shell structure substantially identical to the first shell structure, the first and second shell structures coupled together to form the plurality of compartments. The housing may include a three-dimensional shell structure coupled to a substantially flat backing member and the interior cavity of the housing may be partitioned into the plurality of compartments by a plurality of partition members located therebetween.

The dynamic or animated lighting displays described herein provide particularly aesthetically pleasing decorative displays in a relatively simple and compact form-factor or package.

Further objects and advantages of the lighting displays and methods taught herein will become clear by studying the disclosure, drawings and claims.

DETAILED DESCRIPTION

Figure 1B:
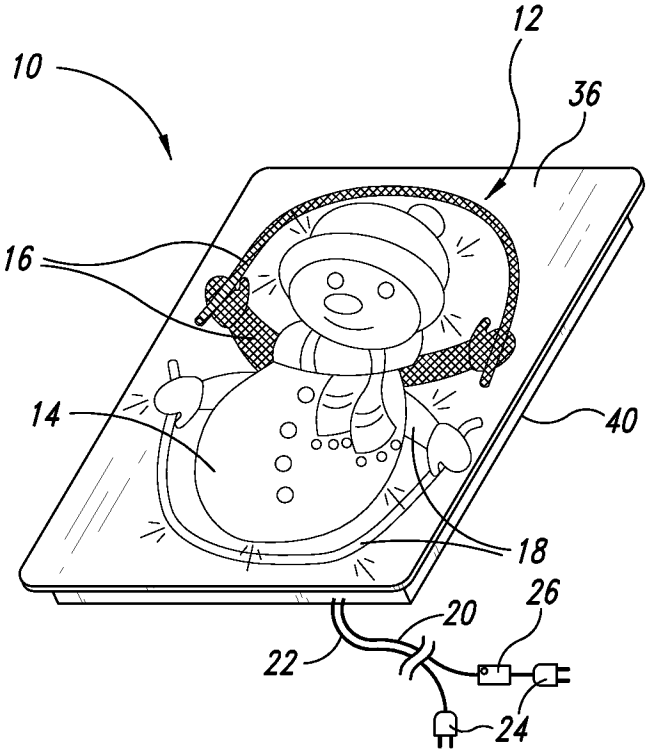
FIG. 1B is an isometric view of the lighting display of FIG. 1A shown in a second illuminated condition.
Figure 1A:
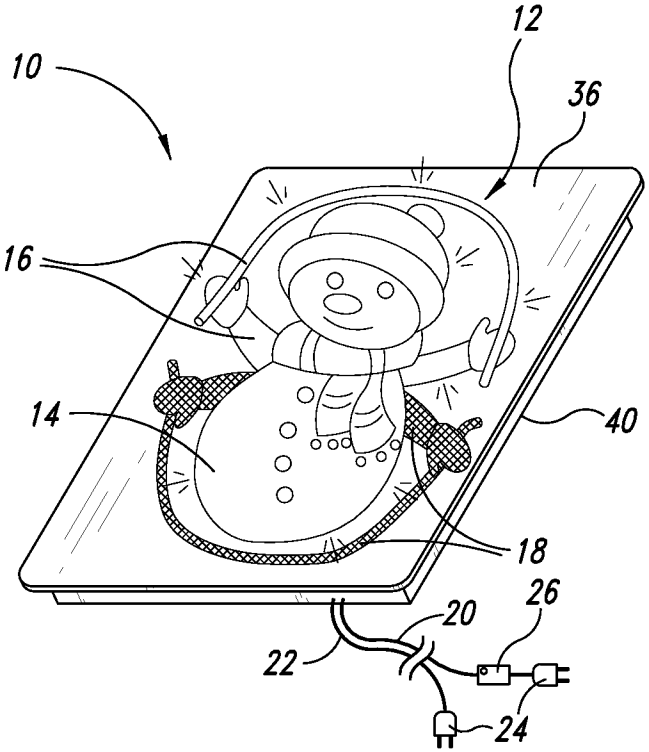
FIG. 1A is an isometric view of a lighting display shown in a first illuminated condition, according to one embodiment.
Figure 2:
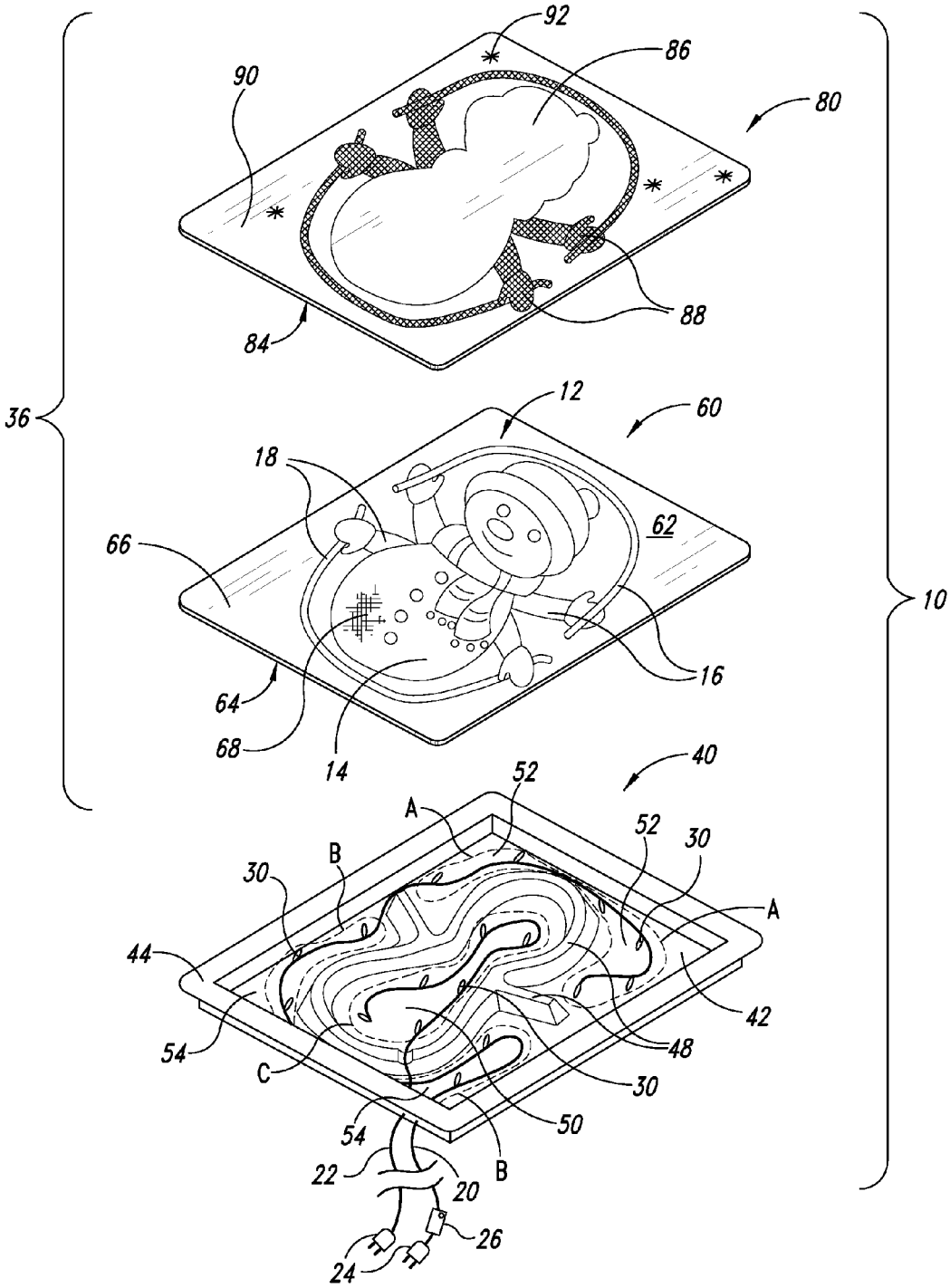
FIG. 2 is an exploded isometric view of the lighting display of FIGS. 1A and 1B.

FIGS. 1A-2 illustrate one embodiment of a decorative lighting display 10 having a dynamic visual effect when activated, and more particularly, an animated visual effect. As used herein, the term "animated" relates to representations of animals or mechanical objects that appear to move, whereas "dynamic" is used in a more general manner to refer to visual representations that are not static, such as, for example, flashing decorative images. The embodiment of the lighting display 10 of FIGS. 1A-2 depicts an image of a snowman character that is configured to transition between a first illuminated state or condition in which the snowman is portrayed as holding a jump rope in an upright position, as illustrated in FIG. 1A, and a second illuminated state or condition in which the snowman is portrayed as holding the jump rope in a downward position, as illustrated in FIG. 1B. When activated, the lighting display 10 transitions between the first and second conditions repeatedly to produce a visual effect of a snowman jumping rope. Although the illustrated embodiment depicts a snowman jumping rope, many different animated characters and/or objects can be displayed, such as, for example, a waving Santa, a flying reindeer or a dancing skeleton.

To produce the aforementioned animated effect, the lighting display 10 includes a display panel 36 that has a decorative image 12 formed therein and which is divided into a number of different image areas or image portions 14, 16, 18. A first image portion 14 includes the body and head of the snowman. A second image portion 16 includes the arms of the snowman and a jump rope in a first position, while a third image portion 18 includes the arms of the snowman and a jump rope in a second position distinct from the first position. Although the illustrated embodiment includes only two positions, more positions could be included.

The display panel 36 is coupled to a housing 40 which is configured to receive one or more strings 20, 22 of lighting elements, such as, for example light bulbs 30 or LEDs. The display panel 36 may be coupled to the housing 40 such as, for example by gluing the display panel 36 to the housing 40 or fastening the display panel 36 to the housing 40 with snaps, clips, hook and loop fasteners or various other fasteners. In the illustrated embodiment, a flange 44 is formed in the perimeter of the housing 40 to receive and support a portion of the display panel 36. Although the housing 40 and flange 44 is illustrated as having a substantially flat receiving surface such that the viewing surface of the display 10 is two-dimensional, in some embodiments, the housing 40 and flange 44 may be configured to include a curved outer surface or the display panel 36 may be contoured such that the viewing surface of the lighting display 10 is three-dimensional without deviating from the scope of the invention.

With the housing 40 and display panel 36 coupled together, the display 10 includes an interior cavity that is partitioned into a plurality of regions or compartments 50, 52, 54 that generally correspond to the various image portions 14, 16, 18 of the display panel 36. For example, a central region 50 of the housing 40 has a contour which roughly mimics the outline of the first image portion 14 of the display panel 36 which overlies the central region 50. The housing 40 further includes an upper region 52 that underlies the second image portion 16 of the jump rope in the upright position and a lower region 54 that underlies the third image portion 18 of the jump rope in the downward position. As shown in the illustrated embodiment, the distinct regions 50, 52, 54 of the housing 40 may be separated from each other by one or more partitions 48. Although the partitions 48 are shown as integral projections extending from the floor 42 of the housing 40, the partitions 48 can include various forms. For example, separate partitioning members may be glued or otherwise coupled to the housing 40 between adjacent compartments.

The partitions 48 effectively separate each of the regions 50, 52, 54 of the housing 40 such that, when the lighting display 10 is activated, light that emanates from one of the regions 50, 52, 54 is partially or substantially blocked from illuminating the other regions. As shown in FIG. 2, the partitions 48 may completely isolate one region from the others, such as, for example, central region 50, or may partially isolate the regions, such as, for example, the partitioning members 48 shown separating the upper region 52 from the lower region 54. In one embodiment, the partitions 48 are formed integrally in the housing 40 using a molding process, such as, for example blow molding or rotation molding. In such embodiments, the entire housing 40 may be formed of a one-piece plastic molded housing 40.

The lighting display 10 further includes at least a first string 20 of light bulbs 30 or LEDs that can terminate in a standard electrical plug 24. The string 20 is constructed so light bulbs 30 contained thereon are strung together on a single elongated strand, the strand comprising two or more wires or conductors between successive bulbs 30 that can be braided or twisted together. Although the string 20 of light bulbs 30 includes a number of different wires braided or twisted together, the string 20 is illustrated in FIG. 2 (and various other Figures) as a single line for purposes of clarity.

As illustrated in FIG. 2, the string 20 of light bulbs 30 includes a first set or group A of bulbs 30 and a second set or group B of bulbs 30. The bulbs 30 within each group A, B are connected or wired together in series by one or more conductors (e.g., wires) such that the bulbs 30 illuminate simultaneously when any one of the bulbs 30 of each respective group A, B is energized. In this manner, the bulbs 30 in group A may simultaneously illuminate the upper region 52 of the housing 40 and the bulbs 30 in group B may simultaneously illuminate the lower region 54 of the housing 40. To produce an animated effect, the first group A and second group B are energized alternately when the display 10 is activated. In one embodiment, each group A, B of bulbs 30 is energized alternately in equal time intervals via a controller 26 coupled to the string 20. Other embodiments feature various other sequences of illuminating the groups A, B of bulbs 30, including sequences in which both groups A, B illuminate simultaneously for a period of time and sequences in which the groups A, B illuminate alternately in unequal time intervals. In some embodiments, the frequency at which the groups A, B sequence may be adjusted by a user, for example, by adjusting a control knob 28 (FIGS. 6-9) located on the controller 26.

With continued reference to FIG. 2, the housing 40 may include a second string 22 of light bulbs 30 that supplements the first string 20 to produce the lighting display 10. The second string 22 includes a third set or group C of light bulbs 30 that are configured to illuminate constantly when the display 10 is activated to illuminate a portion of the image 14 that is desired to be perceived as visually static or that appears the same in all stages of "animation." Although the third group C of bulbs 30 is illustrated as part of a second string 22 of light bulbs 30, in some embodiments, the bulbs 30 shown in the second string 22 (which are configured to illuminate constantly) may be incorporated on the first string 20 on a separate circuit from the bulbs 30 of each of groups A, B. Such embodiments are particularly user-friendly as the entire lighting display 10 can be activated by plugging in the display 10 via a single electrical plug 24. In embodiments featuring more than a single string 20, 22 of light bulbs 30, such as the display 10 illustrated in FIG. 2, a user may couple the electrical plugs 24 together for insertion in a single conventional electrical socket (not shown).

The display panel 36 of FIG. 2 is illustrated as comprising a number of distinct layers, including an image layer 60 and an outer layer 80. In an assembled condition, a lower surface 84 of the outer layer 80 is coupled or affixed to an upper surface 62 of the image layer 60 to form the composite multilayer display panel 36. The lower surface 64 of the image layer 60 and hence display panel 36 is coupled or affixed to the flange 44 of the housing 40 as described earlier. Although the display panel 36 is illustrated as comprising only two distinct layers 60, 80, the panel 36 could include more layers or a single layer with a mask applied thereto.

The image layer 60 of the illustrated embodiment is formed of a single plastic sheet which has a decorative image 12 comprising a plurality of design elements of varying shape and color formed integrally therein. The sheet may have a smooth upper and lower surface 62, 64, or alternatively, either surface 62, 64 may be roughened or textured to diffuse and/or diffract light passing therethrough. As described above, the decorative image 12 may be divided into a number of different image areas or image portions 14, 16, 18. The first image portion 14 corresponds to a portion of the image 12 that is to appear static when the display 10 is activated and the second and third image portions 16, 18 correspond to portions that intermittingly illuminate when activated to produce a dynamic or animated visual effect (i.e., animated portions). Although the decorative image 12 is illustrated as having a solid background 66, it is contemplated that other design elements may surround the decorative image 12.

The outer layer 80 is configured to mask portions of the image layer 60 so that portions of the image 12 that are selected to be illuminated during activation of the display 10 are visible to viewers. Consequently, the outer layer 80 includes at least a first display area 86 and a second display area 90 having a relatively high and relatively low transmissivity, respectively. In this manner, light emanating from the housing 40 passes with relatively more intensity through the first display area 86 and with relatively less intensity through the second display area 90. In some embodiments, the second display area 90 may be opaque and block substantially all light emanating from the housing 40 from passing through the second display area 90. The second display area 90 may also include various design elements 92 formed therein, for example, images of falling snow which surround or supplement the decorative image 12. Although the second display area 90 is illustrated in FIG. 2 as comprising a comprehensive background area 66 that substantially surrounds the profile of the decorative image 12, windows or other areas of high transmissivity of varying shapes and sizes may be placed throughout the outer layer 80 to reveal other images or design elements thereunder. For example, a snowflake-shaped window (not shown) may be located sporadically around the outer profile of the decorative image 12.

The first display area 86 of the outer layer 80 is configured to substantially align with at least a portion of the decorative image 12 of the image layer 60. In some embodiments, the first display area 86 is substantially transparent, and in other embodiments, is translucent or semi-transparent and may include features for diffusing and/or diffracting light passing therethrough, such as, for example, a textured light refracting portion of the image layer 60 that comprises at least a portion of the thickness of the image layer 60. In some embodiments, a diffraction grating or similar structure 68 may be printed or otherwise formed on the image layer 60 to diffract light passing therethrough into various wavelengths to produce a rainbow-like or iridescent effect. The first display area 86 may comprise an area substantially the same as the entire decorative image 12 or an area that corresponds approximately to the first portion 14 of the decorative image 12. In the latter configuration, a third display area 88 having relatively moderate transmissivity may be provided to align with the animated portions 16, 18 of the decorative image 12, for example, the jump rope and arms of the snowman illustrated in FIG. 2 (as indicated with cross-hatching). In this manner, when the display 10 is inactive, the animated portions 16, 18 of the decorative image 12 have a relatively darker appearance than the first portion 14 of the decorative image 12, which remains visually static when the display 10 is activated. Including a display area 88 of relatively moderate transmissivity assists in cloaking the animated portions 14, 16 of the lighting display 10 during intervals when they are not illuminated to create a more convincing animated effect.

Figure 3B:
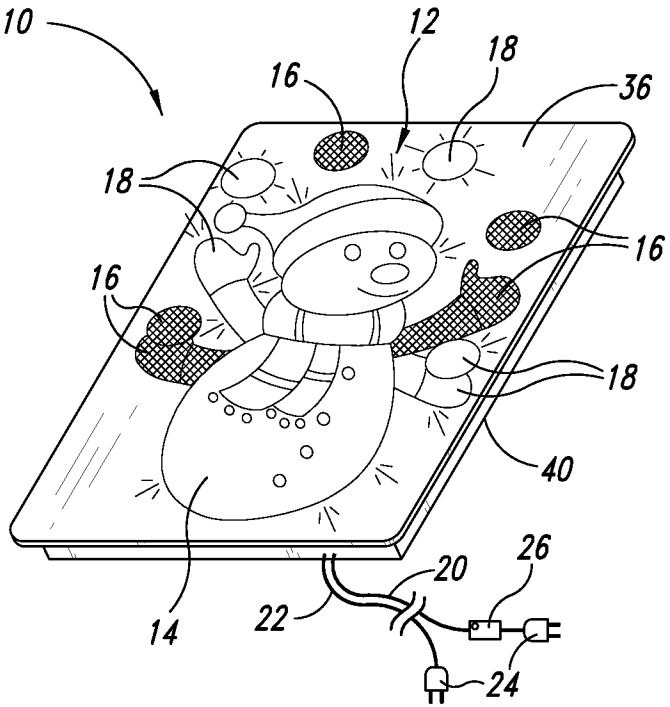
FIG. 3B is an isometric view of the lighting display of FIG. 3A shown in a second illuminated condition.
Figure 3A:
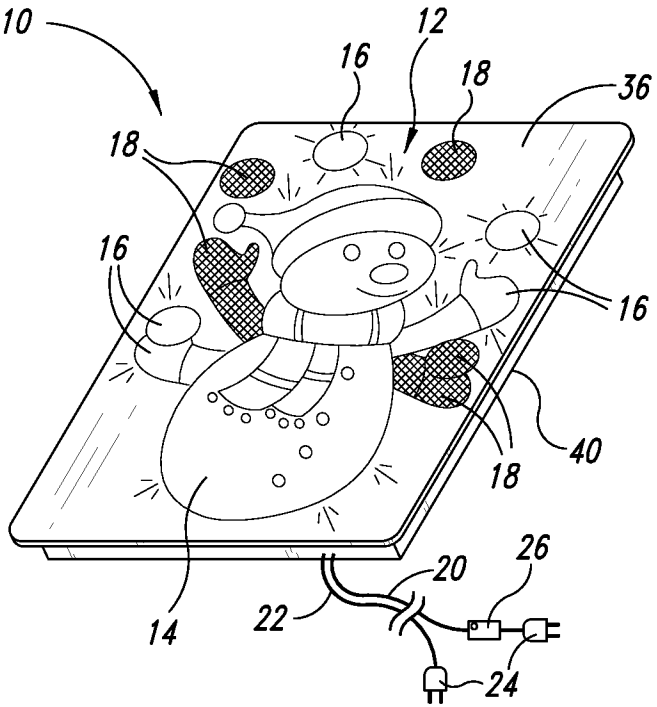
FIG. 3A is an isometric view of a lighting display shown in a first illuminated condition, according to one embodiment.
Figure 4:
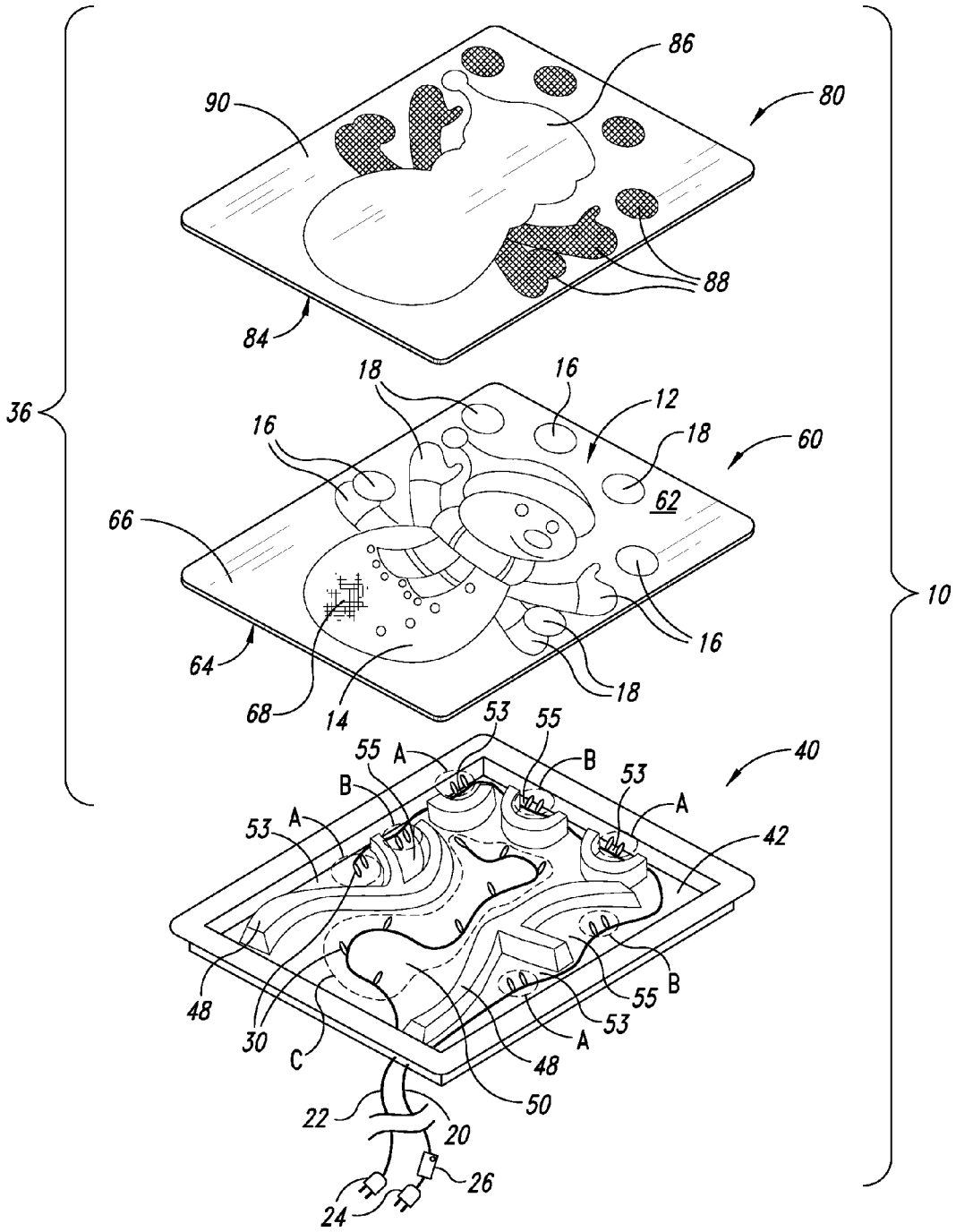
FIG. 4 is an exploded isometric view of the lighting display of FIGS. 3A and 3B.

FIGS. 3A-4 illustrate another embodiment of a decorative lighting display 10 having a dynamic visual effect when activated, and more particularly, an animated visual effect in which a snowman character is configured to transition between a first illuminated state or condition in which the snowman is portrayed juggling balls in a first position, as illustrated in FIG. 3A, and a second illuminated state or condition in which the snowman is portrayed juggling balls in a second position, as illustrated in FIG. 3B. When activated, the lighting display 10 transitions between the first and second conditions repeatedly to produce a visual effect of a snowman actively juggling.

To produce the aforementioned animated effect, the lighting display 10 includes a display panel 36 that has a decorative image 12 formed therein and which is divided into a number of different image areas or image portions 14, 16, 18. A first image portion 14 includes the body and head of the snowman. Second image portions 16 include the arms of the snowman and a number of balls in the first juggling position while third image portions 18 include the arms of the snowman and a number of balls in a second juggling position distinct from the first juggling position. Although the illustrated embodiment includes only two positions, more positions could be included.

Like the embodiments described above, the display 10 includes a display panel 36 and a housing 40 which is configured to receive one or more strings 20, 22 of light bulbs 30. When the housing 40 and display panel 36 are coupled together, the display 10 includes an interior cavity that is partitioned into a plurality of regions or compartments 50, 53, 54 that generally correspond to the various image portions 14, 16, 18 of the display panel 36. For example, a central region 50 of the housing 40 has a contour which roughly mimics the outline of the first image portion 14 of the display panel 36 which overlies the central region 50. The housing 40 further includes a first group of distinct regions 53 that underlie the second image portions 16 of the first juggling position and a second group of distinct regions 55 that underlie the third image portions 18 of the second juggling position. The distinct regions 50, 53, 55 of the housing 40 may be separated from each other by one or more partitions 48 that effectively separate each of the regions 50, 53, 55 of the housing 40 such that, when the lighting display 10 is activated, light that emanates from one of the regions 50, 53, 55 is partially or substantially blocked from illuminating other regions.

The lighting display 10 further includes at least a first string 20 of light bulbs 30 that can terminate in a standard electrical plug 24. The string 20 is constructed so light bulbs 30 contained thereon are strung together on a single elongated strand, the strand comprising two or more wires or conductors between successive bulbs 30 that can be braided or twisted together. Although the string 20 of light bulbs 30 includes a number of different wires braided or twisted together, the string 20 is illustrated in FIG. 4 as a single line for purposes of clarity.

As shown in FIG. 4, the string 20 of light bulbs 30 includes a first group A of intermittently spaced bulbs 30 and a second group B of intermittently spaced bulbs 30. The bulbs 30 within each group A, B are connected or wired together in series by one or more conductors (e.g., wires) such that the bulbs 30 illuminate simultaneously when any one of the bulbs 30 of each respective group A, B is energized. In this manner, the bulbs 30 in group A may simultaneously illuminate the distinct regions 53 of the housing 40 corresponding to the first juggling position and the bulbs 30 in group B may simultaneously illuminate the distinct regions 55 of the housing 40 corresponding to the second juggling position. To produce an animated effect, the first group A and second group B are energized intermittingly when the display 10 is activated. In one embodiment, each group A, B of bulbs 30 is energized alternately in equal time intervals via a controller 26 coupled to the string 20. Other embodiments feature various other sequences of illuminating the groups A, B of bulbs 30, including sequences in which both groups A, B are illuminated simultaneously for a period of time and sequences in which the groups A, B alternate in unequal time intervals. In some embodiments, the frequency at which the groups A, B sequence may be adjusted by a user, for example, by adjusting a control knob 28 (FIGS. 6-9) located on the controller 26.

With continued reference to FIG. 4, the housing 40 may include a second string 22 of light bulbs 30 that supplements the first string 20 to produce the animated display 10. The second string 22 may include a third set or group C of light bulbs 30 that are configured to illuminate constantly when the display 10 is activated to illuminate a portion 14 of the image 12 that is desired to be perceived as visually static. Although the third group C of bulbs 30 is illustrated as part of the second string 22 of light bulbs 30, in some embodiments, the bulbs 30 shown in the second string 22 (which are configured to illuminate constantly) may be incorporated into the first string 20 on a separate circuit from the bulbs 30 of groups A, B. Such embodiments are particularly user-friendly as the entire display 10 can be activated by plugging in the display 10 via a single electrical plug 24. In embodiments featuring more than a single string 20, 22 of light bulbs 30, such as the display 10 illustrated in FIG. 4, a user may couple the electrical plugs 24 together for insertion in a single conventional wall socket (not shown).

The display panel 36 of FIG. 4 is also illustrated as comprising a number of distinct layers, including an image layer 60 and an outer layer 80. In an assembled condition, a lower surface 84 of the outer layer 80 is coupled or affixed to an upper surface 62 of the image layer 60 to form a composite multi-layer display panel 36. The lower surface 64 of the image layer 60 and hence display panel 36 is coupled or affixed to the housing 40. Although the display panel 36 is illustrated as comprising only two distinct layers 60, 80, the panel 36 could include more layers or a single layer having a mask applied thereto.

The image layer 60 of the illustrated embodiment shown in FIG. 4 is formed of a single plastic sheet with a decorative image 12 having a plurality of design elements of varying shape and color formed integrally therein. The sheet may have a smooth upper and lower surface 62, 64, or alternatively, either surface 62, 64 may be roughened or textured to diffuse and/or diffract light passing therethrough. As described above, the decorative image 12 may be divided into a number of different image areas or image portions 14, 16, 18. The first image portion 14 corresponds to a portion of the image 14 that is to appear static when the display 10 is activated and the second and third image portions 16, 18 correspond to portions that intermittingly illuminate when activated to produce a dynamic or animated visual effect (i.e., the animated portions). Although the decorative image 12 is illustrated as having a solid background 66, it is contemplated that other design elements may surround the decorative image 12.

The outer layer 80 is configured to mask portions of the image layer 60 so that the portions of the image 12 that are selected to be illuminated during activation of the display 10 are visible to viewers. Consequently, the outer layer 80 includes at least a first display area 86 and a second display area 90 having a relatively high and relatively low transmissivity, respectively. In this manner, light emanating from the housing 40 passes with relatively more intensity through the first display area 86 and with relatively less intensity through the second display area 90. In some embodiments, the second display area 90 may be opaque and block substantially all light emanating from the housing 40 from passing therethrough. The second display area 90 may also include various design elements 92 formed therein, for example, images of falling snow surrounding the decorative image 12. Although the second display area 90 is illustrated in FIG. 4 as comprising a comprehensive background area 66 that substantially surrounds the profile of the decorative image 12, windows or other areas of high transmissivity of varying shapes and sizes may be placed throughout the outer layer 80 to reveal other images or design elements that may be provided there under. For example, a snowflake-shaped window may be located sporadically around the outer profile of the decorative image 12.

The first display area 86 of the outer layer 80 is configured to substantially align with at least a portion of the decorative image 12 of the image layer 60. In some embodiments, the first display area 86 is substantially transparent, and in other embodiments, is translucent or semi-transparent and may include features for diffusing and/or diffracting light passing therethrough, such as, for example, a textured light refracting portion of the image layer 60 that comprises at least a portion of the thickness of the image layer 60. In some embodiments, a diffraction grating or similar structure 68 may be printed or otherwise formed on the image layer 60 to diffract light passing therethrough into various wavelengths to produce a rainbow-like or iridescent effect. The first display area 86 may comprise an area substantially the same as the entire decorative image 12 or may comprise an area that corresponds approximately to the first portion 14 of the decorative image 12. In the latter configuration, a third display area or areas 88 having relatively moderate transmissivity may be provided to align with the animated portions 16, 18 of the decorative image 12, for example, the balls and arms of the snowman illustrated in FIG. 4 (as indicated by cross-hatching). In this manner, when the display is inactive, the animated portions 16, 18 of the decorative image 12 have a relatively darker appearance than the first portion 14 of the decorative image 12 that remains visually static. Including a display area of relatively moderate transmissivity assists in cloaking the animated portions 14, 16 of the lighting display 10 during intervals when they are not illuminated to create a more convincing animated effect.

Figure 5:
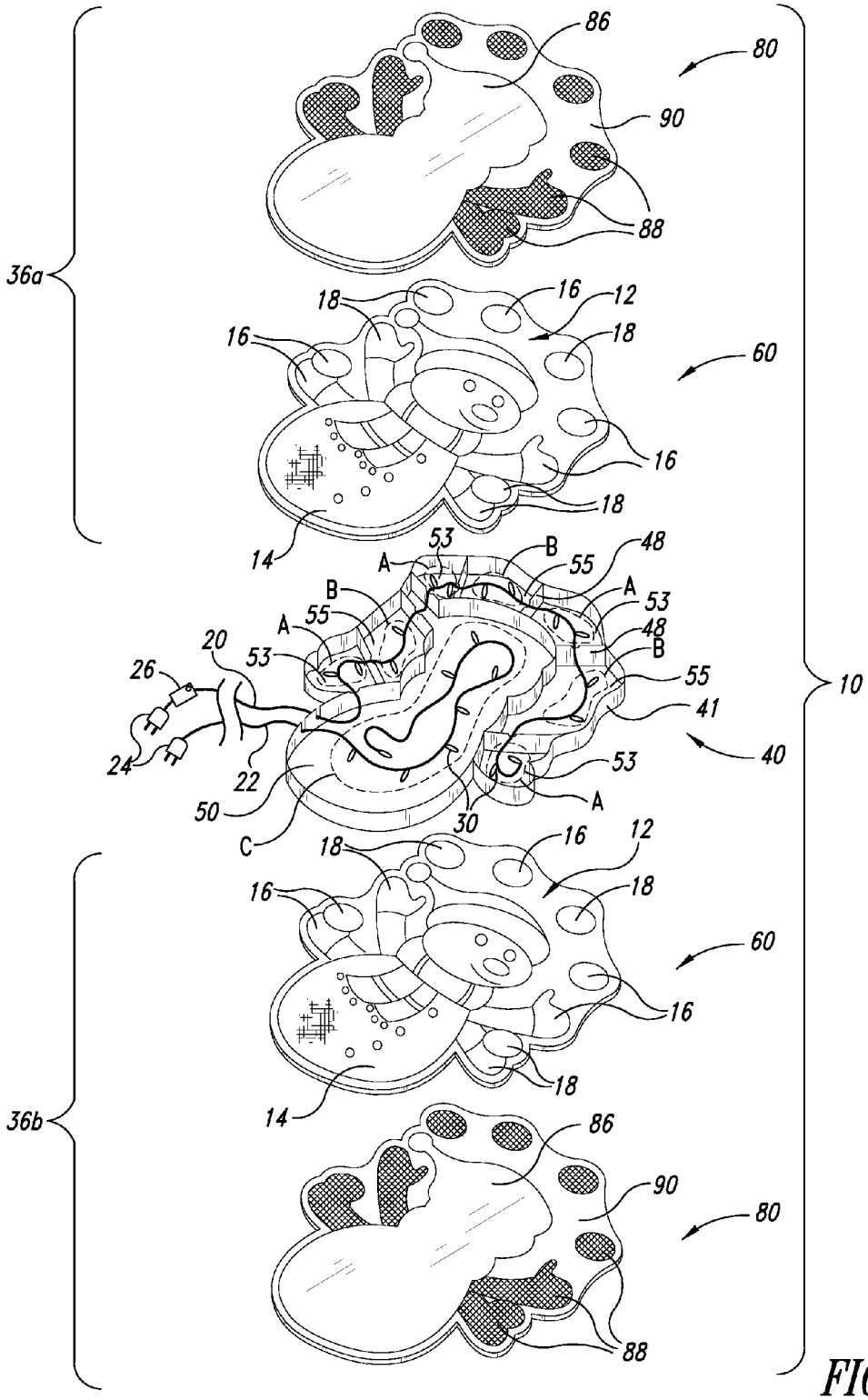
FIG. 5 is an exploded isometric view of a lighting display, according to one embodiment.

FIG. 5 illustrates another embodiment of a decorative lighting display 10 having a dynamic visual effect when activated, and more particularly, an animated visual effect in which a snowman character is configured to transition between a first illuminated state or condition in which the snowman is portrayed juggling balls in a first position, and a second illuminated state or condition in which the snowman is portrayed juggling balls in a second position. When activated, the lighting display 10 transitions between the first and second conditions repeatedly to produce a visual effect of a snowman actively juggling, the animated visual effect visible from opposing sides of the display 10.

To produce the aforementioned animated effect that is visible on opposing sides of the display 10, the lighting display 10 includes a first and a second display panel 36*a*, 36*b*. Each display panel 36*a*, 36*b* has a decorative image 12 formed therein and which is divided into a number of different image areas or image portions 14, 16, 18. A first image portion 14 includes the body and head of the snowman. Second image portions 16 include the arms of the snowman and a number of balls in the first juggling position while third image portions 18 include the arms of the snowman and a number of balls in a second juggling position distinct from the first juggling position. Although the illustrated embodiment includes only two positions, more positions could be included. Furthermore, although the images 12 on each display panel 36*a* and 36*b* are shown as identical images, the images 12 may vary from each other to produce different animated visual effects on opposing sides of the display 10.

Like the embodiments described above, the display 10 includes a housing 40 which is configured to receive one or more strings 20, 22 of light bulbs 30. With the housing 40 and display panels 36*a*, 36*b* coupled together, the display 10 includes an interior cavity that is partitioned into a plurality of regions or compartments 50, 53, 54 that generally correspond to the various image portions 14, 16, 18 of the display panels 36*a*, 36*b*. For example, a central region 50 of the housing 40 has a contour which roughly mimics the outline of the first image portion 14 of the display panels 36*a*, 36*b*. The housing 40 further includes a first group of distinct regions 53 that correspond to the second image portions 16 of the first juggling position and a second group of distinct regions 55 that correspond to the third image portions 18 of the second juggling position. The distinct regions 50, 53, 55 of the housing 40 may be separated from each other by one or more partitions 48 that effectively separate each of the regions 50, 53, 55 of the housing 40 such that, when the lighting display 10 is activated, light that emanates from one of the regions 50, 53, 55 is partially or substantially blocked from illuminating other regions.

The lighting display 10 further includes at least a first string 20 of light bulbs 30 that can terminate in a standard electrical plug 24. The string 20 is constructed so light bulbs 30 contained thereon are strung together on a single elongated strand, the strand comprising two or more wires or conductors between successive bulbs 30 that can be braided or twisted together. Although the string 20 of light bulbs 30 includes a number of different wires braided or twisted together, the string 20 is illustrated in FIG. 5 as a single line for purposes of clarity.

As shown in FIG. 5, the string 20 of light bulbs 30 includes a first group A of intermittently spaced bulbs 30 and a second group B of intermittently spaced bulbs 30. The bulbs 30 within each group A, B are connected or wired together in series by one or more conductors (e.g., wires) such that the bulbs 30 illuminate simultaneously when any one of the bulbs 30 of each respective group A, B is energized. In this manner, the bulbs 30 in group A may simultaneously illuminate the distinct regions 53 of the housing 40 corresponding to the first juggling position and the bulbs 30 in group B may simultaneously illuminate the distinct regions 55 of the housing 40 corresponding to the second juggling position. To produce an animated effect, the first group A and second group B are energized intermittingly when the display 10 is activated. In one embodiment, each group A, B of bulbs 30 is energized alternately in equal time intervals via a controller 26 coupled to the string 20. Other embodiments feature various other sequences of illuminating the groups A, B of bulbs 30, including sequences in which both groups A, B are illuminated simultaneously for a period of time and sequences in which the groups A, B alternate in unequal time intervals. In some embodiments, the speed with which the groups A, B sequence may be adjusted by a user, for example, by adjusting a control knob 28 (FIGS. 6-9) located on the controller 26.

With continued reference to FIG. 5, the housing 40 may include a second string 22 of light bulbs 30 that supplements the first string 20 to produce the animated display 10. The second string 22 may include a third set or group C of light bulbs 30 that are configured to illuminate constantly when the display 10 is activated to illuminate a portion 14 of the image 12 of each panel 36*a*, 36*b* that is desired to be perceived as visually static. Although the third group C of bulbs 30 is illustrated as part of the second string 22 of light bulbs 30, in some embodiments, the bulbs 30 shown in the second string 22 (which are configured to illuminate constantly) may be incorporated into the first string 20 on a separate circuit from the bulbs 30 of groups A, B. Such embodiments are particularly user-friendly as the entire display 10 can be activated by plugging in the display 10 via a single electrical plug 24. In embodiments featuring more than a single string 20, 22 of light bulbs 30, such as the display 10 illustrated in FIG. 5, a user may couple the electrical plugs 24 together for insertion in a single conventional wall socket (not shown).

Each display panel 36*a*, 36*b* of FIG. 5 may be of substantially the same construction as the display panels 36 described above and may contain the same or similar features, such as for example, a multi-layered construction featuring an outer layer 80 and an image layer 60. In some embodiments, the display panels 36*a*, 36*b* may be coupled to the housing 40 wherein the housing 40 is in the form of an open-ended frame 41 having an upstanding perimeter as shown in FIG. 5 to space the first display panel 36*a* from the second opposing display panel 36*b*. The upstanding perimeter may be integrally formed of plastic, for example, via a molding process, or may include a plurality of separate perimeter members coupled together, for example, with adhesive, clips, snaps, zip ties, or other fasteners. Further, the housing 40 may include a number of upstanding partitions 48 for dividing an interior cavity of the housing 40 into the respective regions 50, 53, 55. The partitions 48 may be formed integrally with the open-ended frame 41 or may be separate partition members coupled to the frame 41, for example, with adhesive, clips, snaps, zip ties, or other fasteners.

In one embodiment having a particularly simple form-factor or package, a first display panel 36*a* and a second display panel 36*b* are coupled via adhesive directly to a housing 40 comprising a thin-walled, open-ended frame 41 with one or more light strings 20, 22 routed throughout the frame 41 in such a manner that bulbs 30 from separate groups A, B, C or circuits are positioned in respective regions of the housing 50, 53, 55 to illuminate the regions independent of each other to produce a animated visual effect visible from opposing sides of the display 10. As such, this embodiment is particularly adapted for use as a decorative lighting display placed, for example, in a yard via a stake extending from a bottom portion thereof.

Figure 6:
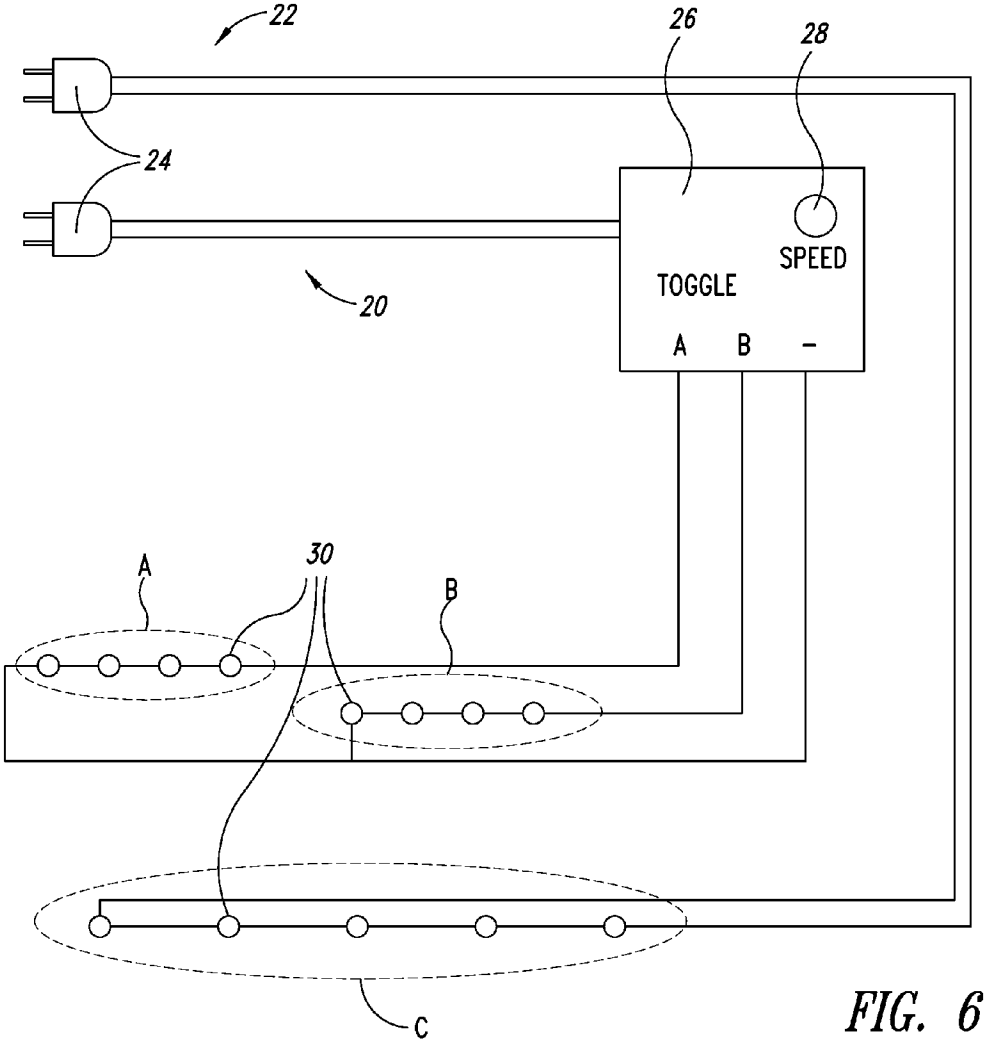
FIG. 6 is a schematic diagram of a first and second string of light bulbs for a lighting display, according to one embodiment.

FIG. 6 is a schematic diagram of a first and second string 20, 22 of light bulbs 30 for a lighting display 10, 100, 200, according to one embodiment. As illustrated, the first string 20 of light bulbs 30 terminates in an electrical plug 24 and includes a plurality of light bulbs 30. The light bulbs 30 of the first string 20 are separated into two distinct groups A, B or circuits along the length of the string 20. The light bulbs 30 within each group A, B are connected together in series by one or more conductors (e.g., wires) such that each group A, B illuminates simultaneously when energized. A controller 26 is shown coupled to the string 20 which can toggle power to each of the groups A, B of bulbs 30 such that each group A, B illuminates intermittingly when the string 20 is energized. In one embodiment, the controller 26 toggles between the groups A, B alternately in equal time intervals. In other embodiments, the groups A, B may have periods of overlapping illumination and in still other embodiments main be alternately illuminated in unequal time intervals. A control knob 28 may be included to adjust the frequency to which the groups A, B of bulbs 30 intermittingly illuminate. A second string 22 of light bulbs 30 containing a third group C of light bulbs 30 is shown independent of the first string 20, the second string 22 can be configured such that the bulbs 30 illuminate constantly when energized. The illustrated schematic diagram of FIG. 6 depicts light strings 20, 22 that are particularly well adapted for use in the lighting display 10 of FIGS. 1A-2, among others.

Figure 7:
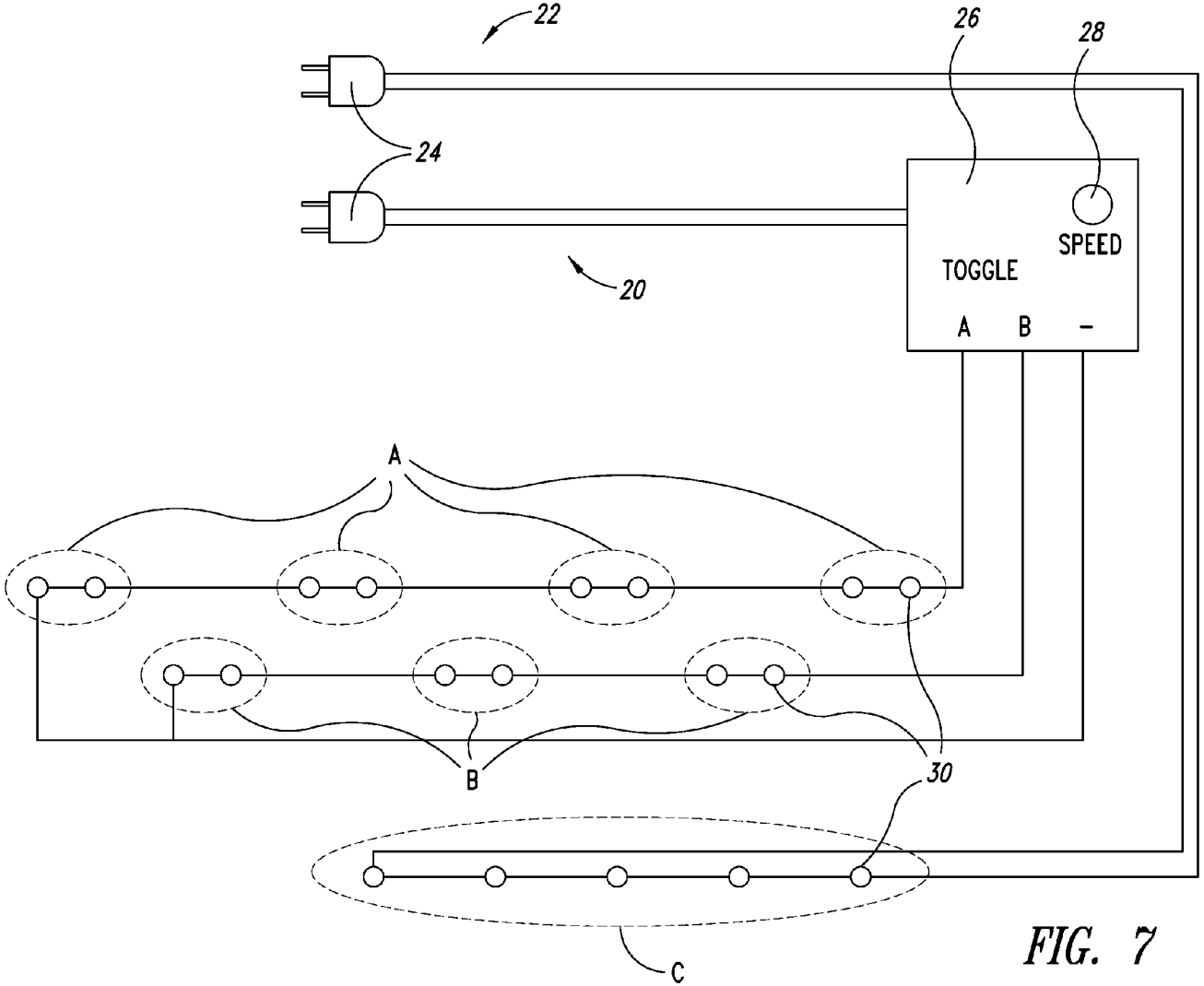
FIG. 7 is a schematic diagram of a first and second string of light bulbs for a lighting display, according to another embodiment.

FIG. 7 is a schematic diagram of a first and second string 20, 22 of light bulbs 30 for a lighting display 10, 100, 200, according to another embodiment. In this embodiment bulbs 30 in each group A, B or circuit are shown physically spaced apart to illustrate that, when the two groups A, B are twisted or braided together in a single strand, a number of the bulbs 30 from group A will fall along the length of the string 20 between bulbs 30 of group B, and vice-versa. Thus, the resulting string 20 features an alternating pattern of bulbs 30 from each group A, B. A second string 22 containing a third group C of light bulbs 30 is shown independent of the first string 20, the second string 22 can be configured such that the bulbs 30 illuminate constantly when energized. In this configuration, the light strings 20, 22 are particularly well adapted for use in a lighting display which features a number of generally alternating regions or compartments, such as, for example, the lighting display 10 shown in FIGS. 3A-4 and the lighting display 10 shown in FIG. 5.

Figure 8:
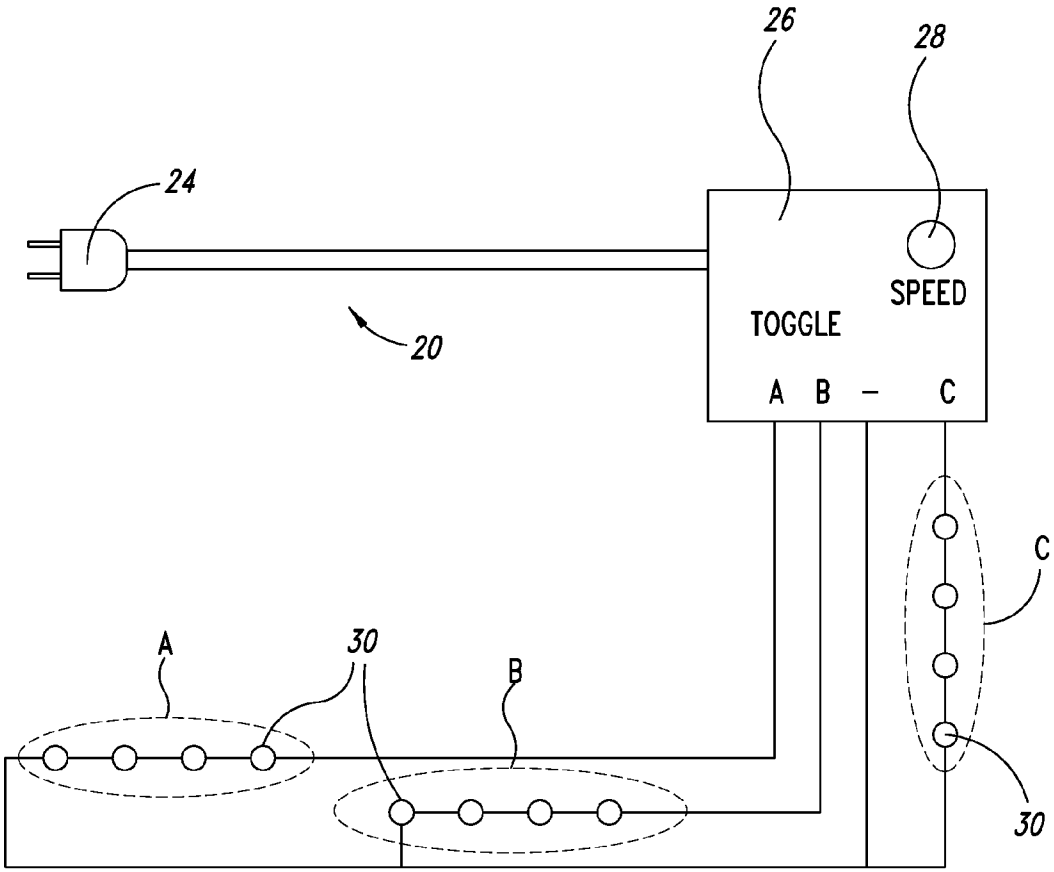
FIG. 8 is a schematic diagram of a string of light bulbs for a lighting display, according to one embodiment.

FIG. 8 is a schematic diagram of a string 20 of light bulbs 30 for a lighting display 10, 100, 200, according to another embodiment. More particularly, the schematic diagram illustrates a variation in which the bulbs 30 of a third group C or circuit are included within a first string 20 of light bulbs 30 together with the bulbs 30 of the distinct groups A, B or circuits. In this manner, a single string 20 includes two groups A, B of light bulbs 30 that are configured to illuminate intermittingly and one group C configured to illuminate constantly. Although all of the bulbs 30 within each group A, B, C are shown in close proximity to each other along the length of the string 20, it is contemplated that one or more light bulbs 30 within each group A, B, C may be located remotely from other bulbs 30 in each respective group and may be sequenced in any order along the length of the string 20.

Figure 9:
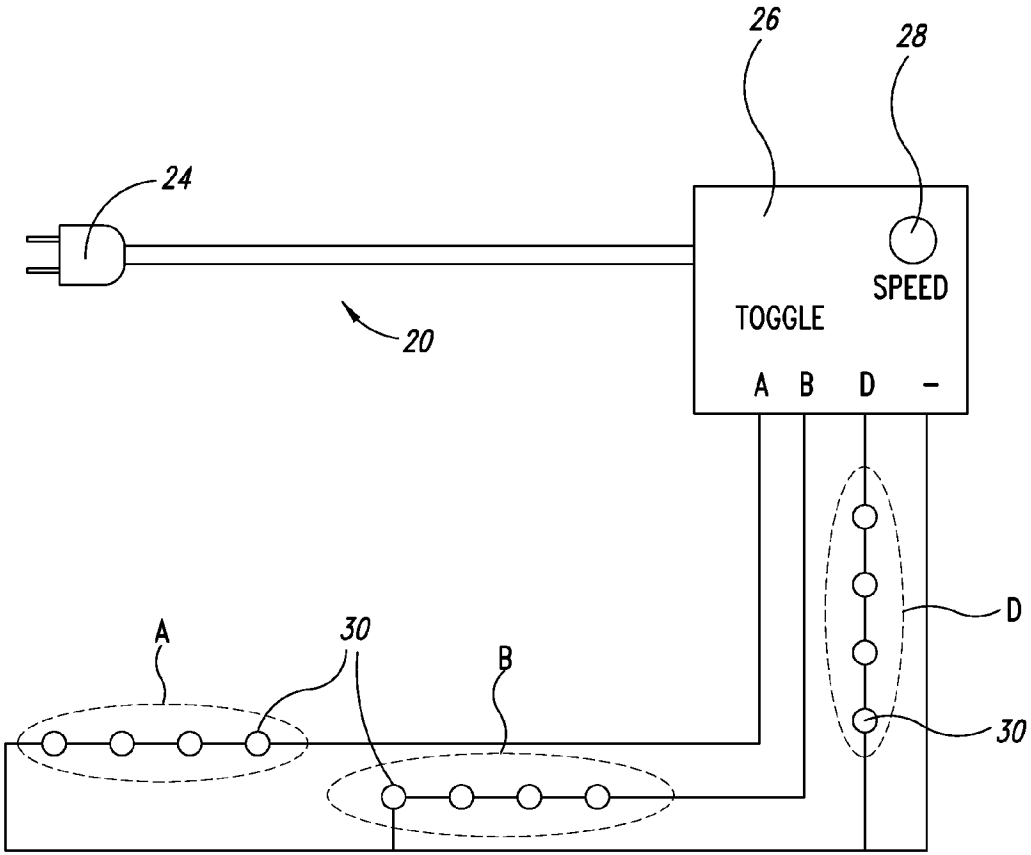
FIG. 9 is a schematic diagram of a string of light bulbs for a lighting display, according to another embodiment

FIG. 9 is a schematic diagram of a string 20 of light bulbs 30 for a lighting display 10, 100, 200, according to yet another embodiment. This schematic diagram illustrates a variation in which three groups A, B, D of light bulbs 30 are located on a common string 20, each group A, B, D being configured to illuminate intermittingly. Like the embodiments described above, a controller 26 may be provided to toggle power between the three groups A, B, D of light bulbs 30 in various sequences. For example, the groups A, B, D may illuminate sequentially and repeatedly in equal intervals.

Collectively, the schematic diagrams of FIGS. 6-9 illustrate that one or more light strings 20, 22 may be configured to include a plurality of light bulbs 30 or other lighting elements organized in various sequences to provide a coordinated source of light for the dynamic and animated displays 10, 100, 200 discussed herein. One of ordinary skill in the art will appreciate that many other configurations are possible without deviating from the scope of the invention.

A method for making a lighting display according to one embodiment is described with reference to FIG. 2 and begins where a housing 40 having a plurality of distinct regions is provided, the housing 40 including at least a first region 52 and a second region 54. Next, at least a portion of each of a first and a second group A, B of lighting elements (e.g., bulbs 30, LEDs) of a first string 20 are positioned in the first and second regions 52, 54, respectively, the lighting elements within each group A, B connected to each other in series by one or more conductors to illuminate simultaneously when energized and configured such that, when the lighting display 10 is activated, the one or more lighting elements contained in the first region 52 intermittingly illuminate a first portion of the display 10 and the one or more lighting elements contained in the second region 54 intermittingly illuminate a second portion of the display 10 to produce a dynamic or animated visual effect. In some embodiments, the method may further include coupling at least a portion of a third group C of lighting elements that are connected to each other to illuminate simultaneously when energized to a third region 50 of the housing 40 that is distinct from the first and second regions 52, 54 such that, when the display 10 is activated, one or more lighting elements contained in the third region 50 constantly illuminate a third portion of the display 10 while being substantially shielded from illuminating the first or second portions of the display 10.

In some embodiments, the method may further include coupling a first display panel 36 having a decorative image 12 formed therein to the housing 40 with a portion 16 of the decorative image 12 aligned with the first region 52 and another portion 18 of the image aligned with the second region 54 such that, when the lighting display is activated, the one or more lighting elements contained in the first region 52 intermittingly illuminate the first portion 16 of the decorative image and the one or more lighting elements contained in the second region 54 intermittingly illuminate the second portion 18 of the decorative image to produce an animated visual effect. In some embodiments, the first display panel 36 may include an image layer 60 coupled to an outer layer 80, the image layer 60 having at least a first area of relatively high transmissivity and containing the decorative image 12, and the outer layer 80 including at least a first display area 86 of relatively high transmissivity aligned with a portion of the decorative image 12 and a second display area 90 that is at least substantially opaque surrounding at least a portion of the decorative image 12.

In some embodiments, the method may further include coupling a second display panel having a corresponding decorative image formed therein to the housing opposite the first display panel with a first corresponding portion of the corresponding decorative image aligned with the first region and a second corresponding portion of the corresponding decorative image aligned with the second region. In this manner, when the lighting display is activated, the one or more lighting elements contained in the first region intermittingly illuminate the first portion of the decorative image and the first corresponding portion of the corresponding decorative image and the one or more lighting elements contained in the second region intermittingly illuminate the second portion of the decorative image and the second corresponding portion of the corresponding decorative image to produce an animated visual effect on opposing sides of the housing. The corresponding decorative image may be the same or different from the decorative image of the first display panel.

An individual of ordinary skill in the art, having reviewed this disclosure, will appreciate that the steps of above methods can be exchanged in some instances, and/or can be combined in different sequences or without all of the other steps, to make other suitable lighting displays 10, 100, 200 having a dynamic or animated visual effect. For example, coupling at least a portion of a third group C of lighting elements that are connected to each other to illuminate simultaneously when energized to a third region 50 of the housing 40 may be omitted in some embodiments.

Figure 10B:
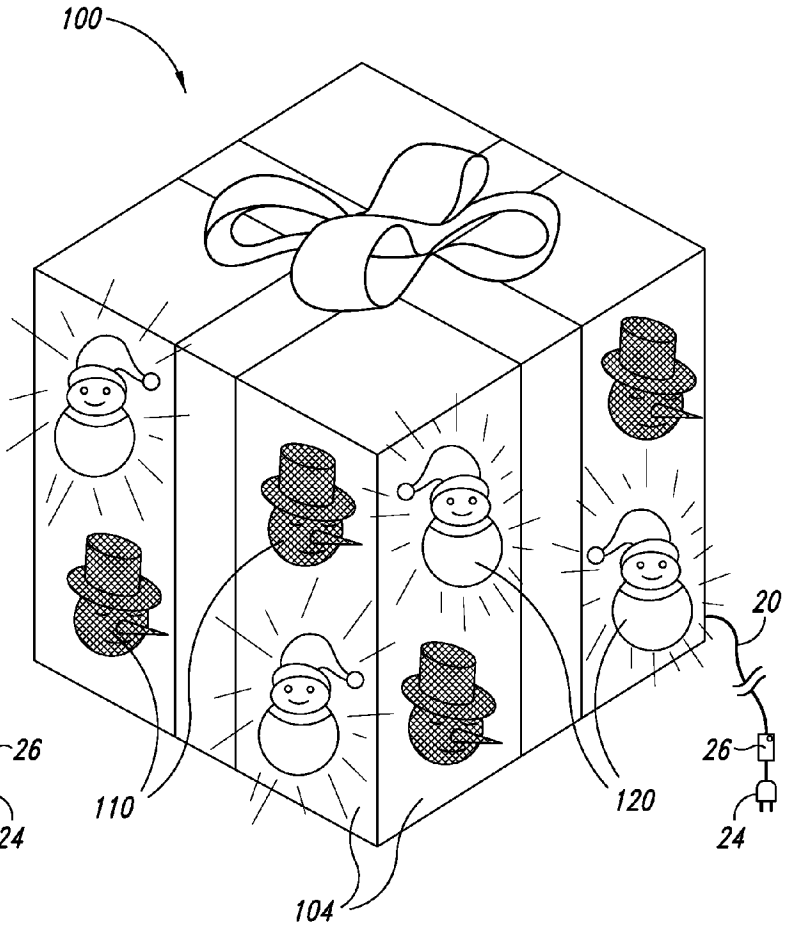
FIG. 10B is an isometric view of the lighting display of FIG. 10A shown in a second illuminated condition.
Figure 10A:
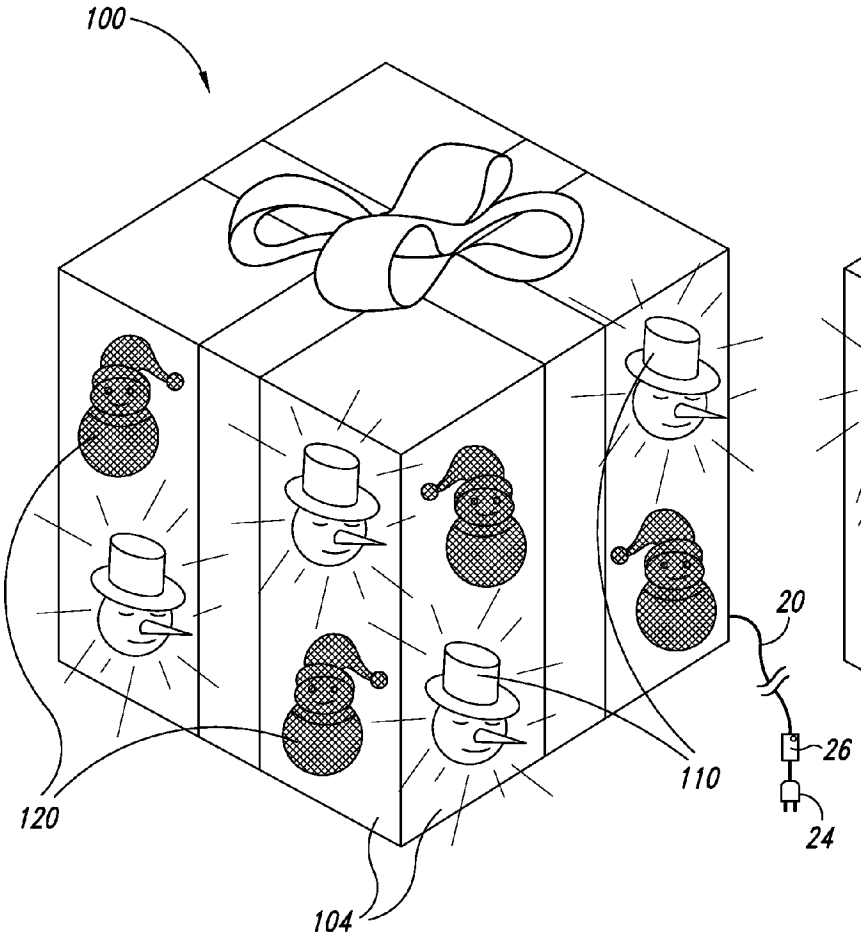
FIG. 10A is an isometric view of a lighting display shown in a first illuminated condition, according to one embodiment.
Figure 11:
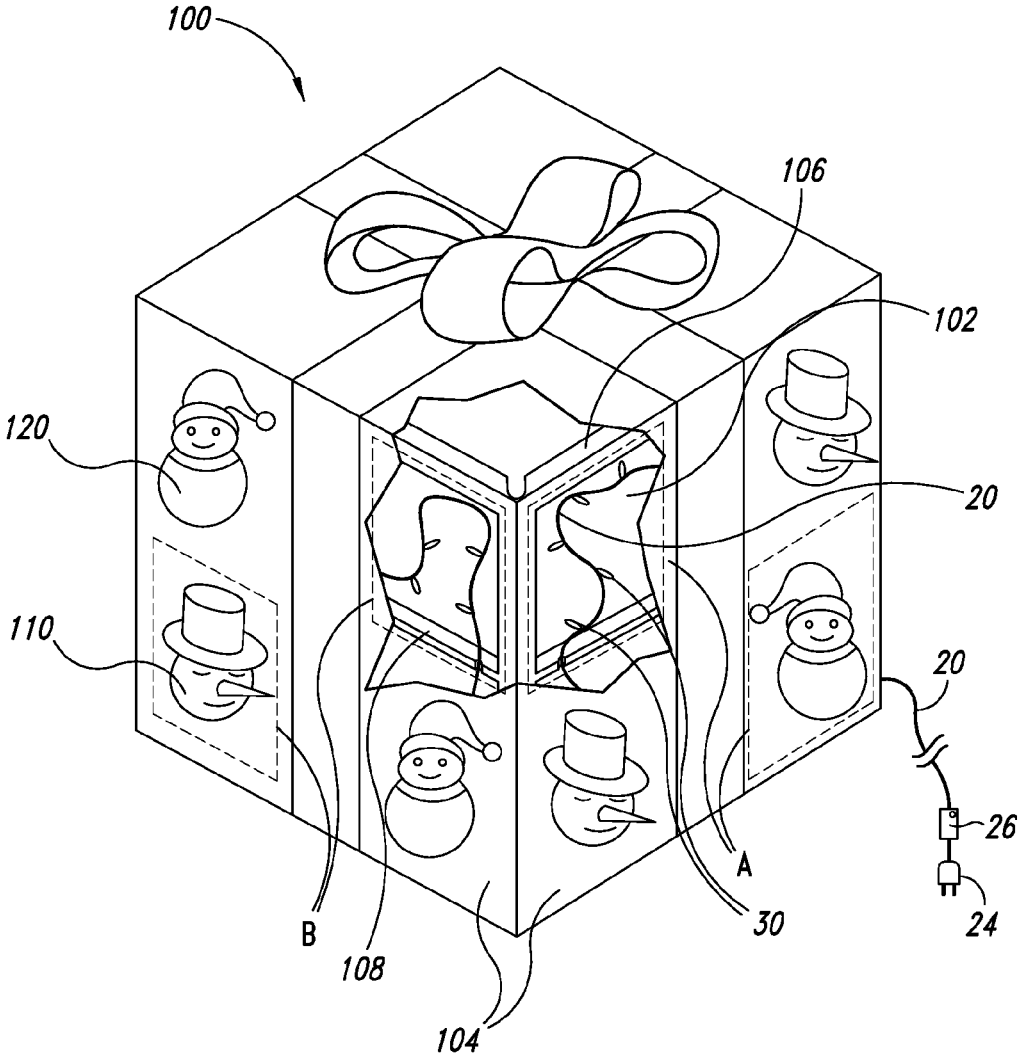
FIG. 11 is a partially cut-away isometric view of the lighting display of FIGS. 10A and 10B.

FIGS. 10A-11 illustrate another embodiment of a decorative lighting display 100 having a dynamic visual effect when activated. The lighting display 100 comprises a three-dimensional frame or housing wherein the exterior surface of the display 100 includes a plurality of display panels 104. Each of the display panels 104 may be structured as described above to include an image layer comprising a decorative image formed therein and an outer layer having at least a region or area of relatively high transmissivity such that the decorative image is visible to a viewer when the display 100 is activated.

As illustrated in FIGS. 10A and 10B, the display panel 104 may include an alternately pattern of decorative images in which various images are illuminated simultaneously while others remain dark. For example, the illustrated embodiment of FIGS. 10A-11 features a sequence in which a first group of decorative images 110 is illuminated while a second group of decorative images 120 remains dark (FIG. 10A), and then alternates such that the first group of decorative images 110 is dark while the second group 120 is illuminated (FIG. 10B). The animated displays discussed above could likewise be incorporated into this display 100, or vice versa.

In order to provide a coordinated light source to produce the described dynamic visual effect, at least one string 20 of light bulbs 30 or LEDs terminating in a conventional electrical plug 24 is coupled to an interior portion of the display 100, such as, for example, by gluing or fastening the bulbs 30 thereto with clips, snaps or other fasteners. More particularly, as illustrated in FIG. 11, the one or more strings 20 of light bulbs 30 are routed through various partitioned regions or compartments 102 formed within the display 100, such as, for example, by providing baffles, walls 108 or other partitioning structures between adjacent regions or compartments 102. As such, one or more of the light bulbs 30 of the string 20 are positioned within a distinct region or compartment 102 of the display 100 behind a portion of a display panel 104. The bulbs 30 within each compartment 102 are connected in series to illuminate simultaneously when activated. Furthermore, the bulbs 30 of any one compartment may be connected in series with one or more other compartments 102 to illuminate simultaneously therewith. As illustrated in FIG. 11, the bulbs 30 within group A are configured to illuminate simultaneously, as are the bulbs 30 within group B. The string 20 may further include a controller 26 to toggle power between the groups A, B of bulbs 30 and intermittingly illuminate the groups A, B in various sequences and speeds.

In some embodiments, the three-dimensional display 100 may include several independent housings 106 that are structurally similar to the housings described elsewhere, such as, for example, a molding plastic housing with integral partitions extending from the housing floor. In other embodiments, the three-dimensional display 100 may comprise a substantially hollow shell structure with thin-walled partition members extending from an interior surface of the shell to create distinct regions or compartments. In still further embodiments, the three-dimensional display 100 may include a housing constructed of a frame of elongated members formed in a three-dimensional shape and covered with a sheet material, such as, for example, fabric or plastic sheeting. One of ordinary skill in the art will appreciate that many other configurations are possible without deviating from the scope of the invention.

FIGS. 12A-D illustrate another embodiment of a decorative lighting display 200 having a dynamic visual effect when activated. The lighting display 200 comprises a three-dimensional housing 220 having an interior cavity partitioned into a plurality of compartments or regions. More particularly, the lighting display 200 depicts a three-dimensional snowflake formed of a thin-walled structure having internal baffle structures 210 to partition the display 200 into a central region 202, a plurality of intermediate regions 204 and a corresponding number of end regions 206. In one embodiment, the display housing 220 includes a thin-walled shell structure comprising two identical shell halves 220*a*, 220*b* that are coupled together, such as, for example, by gluing or fastening the shell halves 220*a*, 220*b* together with snaps, clips or other fasteners. As an example, the illustrated embodiment in FIGS. 12A-D includes substantially identical shell halves 220*a*, 220*b* with apertures 230 located at end portions thereof for securing the halves 220*a*, 220*b* together with pins, rivets, zip ties or other similar fasteners. In other embodiments, the housing 220 may include a three-dimensional shell structure 220*b* coupled to a substantially flat backing member (not shown). In such embodiments, separate or integrally formed partitions may span from the shell structure 220*b* to the backing member to divide the interior cavity into the separate compartments, or vice versa. Embodiments having a flat backing member are particularly suitable for mounting the lighting display to flat surfaces, such as, for example, a window or a wall. These displays, as well as other displays described herein, may be hung or otherwise attached to such flat surfaces with hooks, suction cups or various other devices for hanging visual displays.

The housing 220 is preferably formed of a translucent or semi-transparent plastic material such that light may emanate outwardly from the housing 220 when the display 200 is activated. The housing 220 may further include features for diffusing and/or diffracting light passing therethrough, such as, for example, a textured light refracting portion that comprises at least a portion of the thickness of the housing 220 or a layer of translucent beads applied to or integral with a surface of the housing 220. In some embodiments, a diffraction grating or similar structure may be printed or otherwise formed on the housing to diffract light passing therethrough into various wavelengths to produce a rainbow-like or iridescent effect.

Figure 12B:
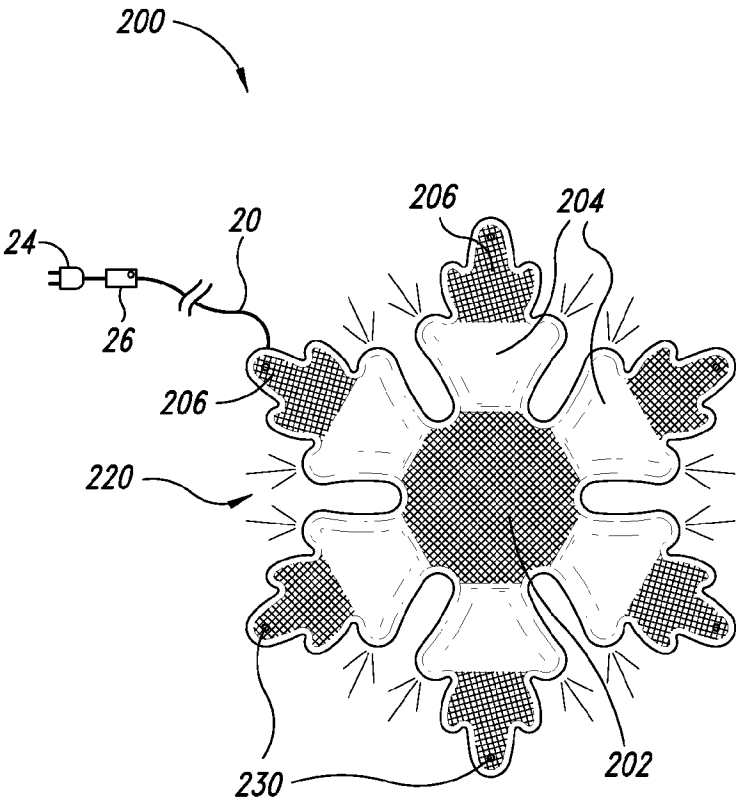
FIG. 12B is a front elevational view of the lighting display of FIG. 12A shown in a second illuminated condition.
Figure 12A:
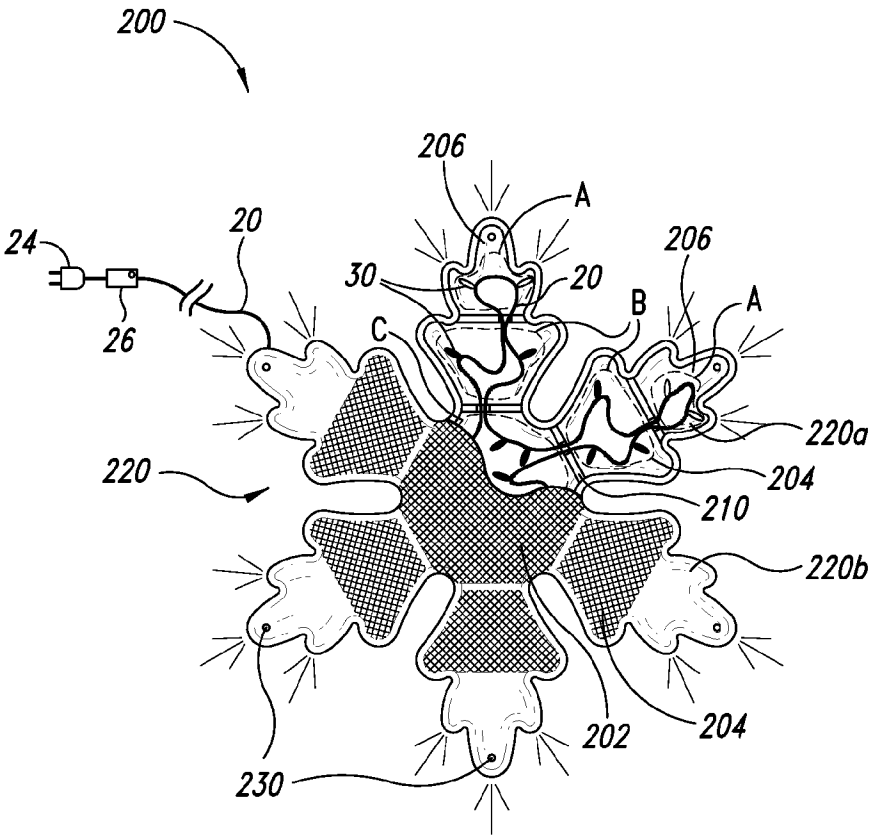
FIG. 12A is a partially cut-away front elevational view of a lighting display shown in a first illuminated condition, according to one embodiment.

A string 20 of light bulbs 30 terminating in a conventional electrical plug 24 is routed through each region of the display 200 such that one or more light bulbs 30 are positioned in each region. More particularly, the string 20 of light bulbs 30 is routed such that the end regions 206 all contain lights of a common group A or circuit, the intermediate regions 204 all contain lights of a common group B or circuit, and the central region 202 contains lights of a common group C or circuit, as illustrated in FIG. 12A. The bulbs 30 within each group A, B, C are connected in series to illuminate simultaneously and are further configured to illuminate intermittingly when the display 200 is activated.

Figure 12D:
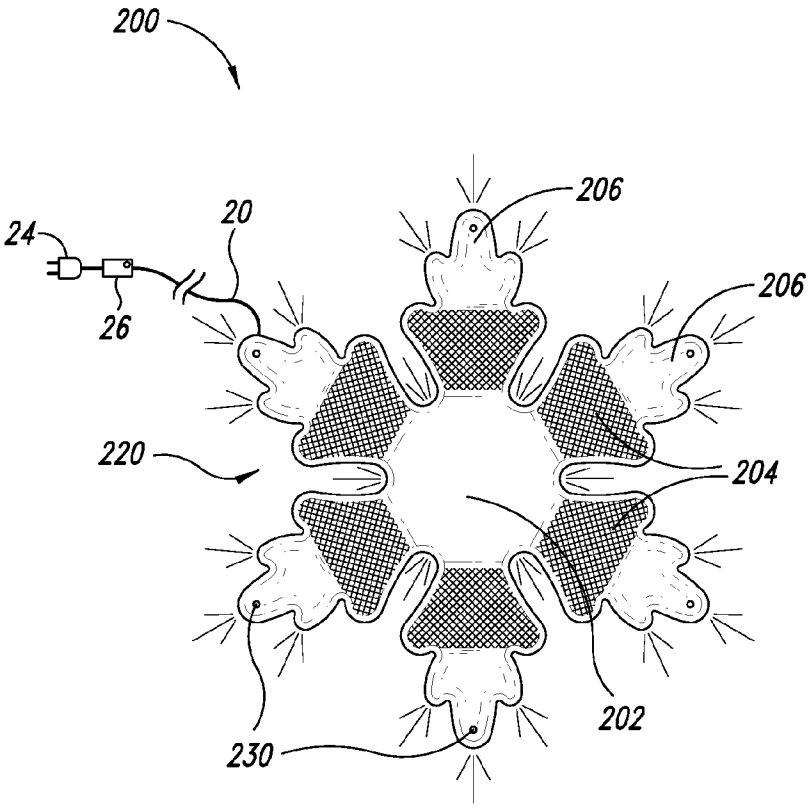
FIG. 12D is a front elevational view of the lighting display of FIG. 12A shown in a fourth illuminated condition.
Figure 12C:
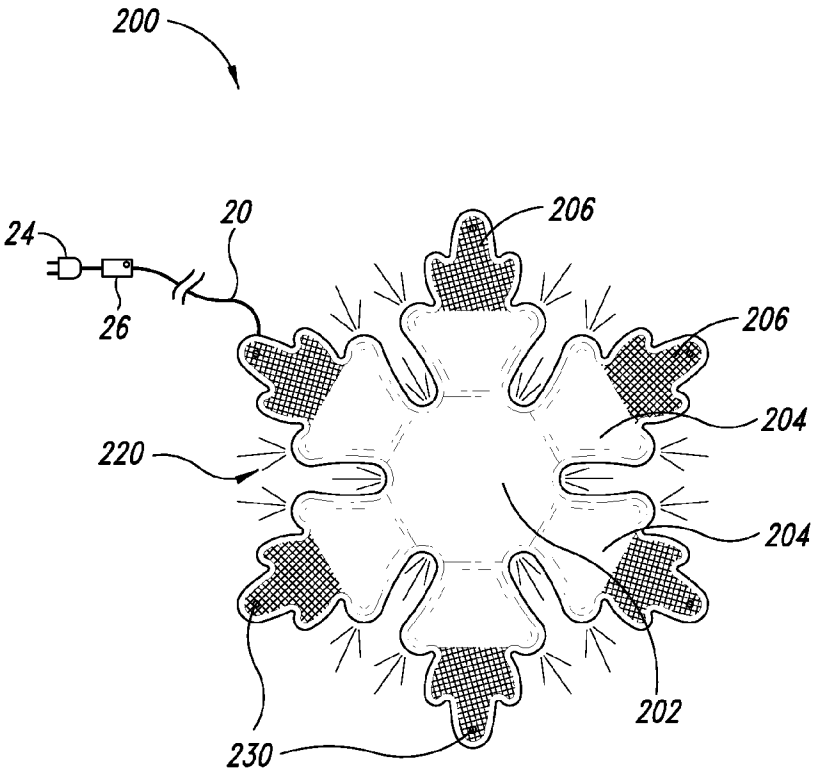
FIG. 12C is a front elevational view of the lighting display of FIG. 12A shown in a third illuminated condition.

A controller 26 is coupled to the string 20 of light bulbs 30 to sequence the illumination of each respective grouping of regions. For example, the end regions 206, intermediate regions 204 and central region 202 can be configured to illuminate in the sequence illustrated in FIGS. 12A-D. More specifically, as shown in FIG. 12A, the sequence begins with the end regions 206 temporarily illuminating while the central region 202 and intermediate regions 204 remain dark (as indicated by cross-hatching). Then, as shown in FIG. 12B, the intermediate regions 204 illuminate while the end regions 206 and central region 202 remain dark. The sequence progresses, as shown in FIG. 12C, with the central region 202 illuminating while the intermediate regions 204 remain lit and the end regions 206 remain dark. Lastly, as shown in FIG. 12D, the central region 202 remains lit and the end regions 206 illuminate while the intermediate regions 204 go dark. The sequence repeats to create a lighting display 200 having a particularly aesthetically pleasing dynamic effect in which light sequentially radiates from the display 200. Other sequences and/or configuration could be incorporated. Although the exterior of the display 200 is shown blank, the display 200 may include various images or light diffusing and/or diffracting structures. For example, in one embodiment, an external shell structure of the display 200 may include a multi-layer display panel configured as described above. In other embodiments, at least a portion of a thickness of the outer shell of the display 200 may be treated or configured to diffuse and/or diffract light passing therethrough.

The various embodiments described above can be combined to provide further embodiments. All of the U.S. patents, U.S. patent application publications, U.S. patent application, foreign patents, foreign patent application and non-patent publications referred to in this specification and/or listed in the Application Data Sheet are incorporated herein by reference, in their entirety. Aspects of the embodiments can be modified, if necessary to employ concepts of the various patents, application and publications to provide yet further embodiments.

These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

The invention claimed is:

1. A decorative lighting display comprising:

a first string of lighting elements that are independently repositionable, the first string of lighting elements terminating in an electrical plug and having at least a first group and a second group of lighting elements, the lighting elements within each group of the first string being connected to each other in series by one or more conductors to illuminate simultaneously when energized;

a display housing having an internal cavity defined by an outer perimeter and a continuous floor that spans the entire internal cavity within the outer perimeter, the internal cavity having a plurality of distinct internal regions that are separated from each other by one or more partition members to form a partitioned interior cavity, one or more of the lighting elements of the first group of lighting elements of the first string being positioned in a first region of the display housing and one or more of the lighting elements of the second group of lighting elements of the same first string being positioned in a second region of the display housing separate from the first region; and a first composite multi-layered display panel coupled to the display housing, the first composite multi-layered display panel being substantially flat and planar and having at least an image layer panel and an outer layer panel coupled to the image layer panel, the image layer panel formed from a first single plastic sheet and including a decorative image including at least a first and a second animated display portion and a static display portion, the outer layer formed from a first single plastic sheet and including a high transmissivity display area, an intermediate transmissivity display area, and a low transmissivity display area, the high transmissivity display area having a shape corresponding to the shape of the static display portion of the image layer, the intermediate transmissivity display area corresponding to a shape of the first and second animated display areas, and the low transmissivity display area corresponding to a shape of a background area that substantially surrounds the decorative image, the first region of the display housing being defined by a first partition member, a contour of the first partition member and a contour of the first internal region corresponding to the first animated display portion of the image layer and, the second region of the display housing being defined by a second partition member, a contour of the second partition member and a contour of the second internal region corresponding to an outline of the second animated display portion of the image layer, wherein, when the lighting display is activated, the one or more lighting elements positioned in the first region intermittingly illuminate a first portion of the display and the one or more lighting elements positioned in the second region intermittingly illuminate a second portion of the display, the intermittent illumination of the first and second portions of the display cooperating to produce a dynamic visual effect, wherein, the partition members are at least substantially opaque;

wherein, the first group and the second group of lighting elements are strung together on a single strand, wherein the display housing is a one-piece plastic molded housing and the one or more projections extend from a lower surface of the housing to partition the housing into the plurality of regions, and wherein the plurality of regions are partitioned such that, when the lighting display is activated, light emanating from one of the regions is substantially prevented from illuminating any other region by the one or more partitions that separate the regions.

2. The lighting display of claim 1 wherein the first string of lighting elements includes a controller configured to illuminate the first and second groups of lighting elements alternately.

3. The lighting display of claim 1, further comprising:

a second string of lighting elements that are independently repositionable, the second string of lighting elements terminating in an electrical plug, one or more of the lighting elements of the second string positioned in a third region separate from the lighting elements of the first string, and having a shape that corresponds to the shape of the static display portion of the image layer and configured to constantly illuminate a third portion of the display when the lighting display is activated.

4. The lighting display of claim 1 wherein the display housing is an open-ended frame and the one or more partition members divide the open ended frame into the plurality of regions.

5. The lighting display of claim 1 wherein the low transmissivity display area is at least substantially opaque.

6. The lighting display of claim 1 wherein at least a portion of a thickness of the image layer is configured to diffract light passing therethrough.

7. The lighting display of claim 1 wherein at least a portion of a thickness of the image layer is configured to refract light passing therethrough.

8. The lighting display of claim 1 wherein the image layer is a single plastic sheet having a smooth surface and a textured opposing surface.

9. The lighting display of claim 8 wherein the decorative image includes a plurality of design elements of varying shape and color and is integrally formed in the plastic sheet.

10. The lighting display of claim 1 wherein the display housing includes a substantially flat outer surface for receiving the first display panel such that a viewing surface of the lighting display is substantially two-dimensional.

11. The lighting display of claim 1 wherein the display housing includes a curved outer surface for receiving the first display panel such that a viewing surface of the lighting display is three-dimensional.

12. The lighting display of claim 1, further comprising:

a second multi-layered display panel coupled to the display housing opposite the first multi-layered display panel such that, when the lighting display is activated, the one or more lighting elements positioned in the first region intermittingly illuminate a first portion of the decorative image on the first display panel and a first corresponding portion of a corresponding decorative image on the second display panel and the one or more lighting elements positioned in the second region intermittingly illuminate a second portion of the decorative image on the first display panel and a second corresponding portion of the corresponding decorative image on the second display panel, the intermittent illumination of the first and second portions of the decorative image of the first display panel and the corresponding first and second portions of the corresponding decorative image of the second display panel cooperating to produce an animated visual effect on opposing sides of the display housing.

13. A decorative lighting display comprising:

a housing having one or more partitions to divide the housing into a plurality of distinct internal regions;

a first string of lighting elements that are independently repositionable, the first string of lighting elements terminating in an electrical plug and being coupled to the housing with one or more lighting elements of the first string positioned in a first region of the housing and one or more lighting elements of the same first string positioned in a second region of the housing; and a first display panel coupled to the housing and having at least an image layer, the image layer containing a decorative image and being formed of a single plastic sheet wherein at least a portion of a thickness of the sheet is configured to diffract light passing therethrough and including at least a first and a second animated display portion, a first of the partitions having a first shape that corresponds to a shape of the first animated display portion and a second of the partitions having a second shape that corresponds to a shape of the second animated display portion;

wherein, the partitions are at least substantially opaque;

wherein, the one or more lighting elements of the first string positioned in the first region of the housing and the one or more lighting elements of the same first string positioned in a second region of the housing are strung together on a single strand, wherein, when the lighting display is activated, the one or more lighting elements of the first string positioned in the first region of the housing intermittingly illuminate the first animated display portion of the decorative image and the one or more lighting elements of the same first string positioned in the second region of the housing intermittingly illuminate the second animated display portion of the decorative image, the intermittent illumination of the first and second portions of the decorative image cooperating to produce an animated visual effect, wherein the housing includes a lower surface and the one or more partitions extend from the lower surface of the housing to partition the housing into the plurality of distinct internal regions, and wherein the plurality of distinct internal regions are partitioned such that, when the lighting display is activated, light emanating from one of the regions is substantially prevented from illuminating any other region by the one or more partitions that separate the regions.

14. The lighting display of claim 13, further comprising:

a second string of lighting elements that are independently repositionable, one or more of the lighting elements of the second string positioned in a third region of the housing separate from the lighting elements of the first string and configured to constantly illuminate a third portion of the decorative image when the lighting display is activated.

15. The lighting display of claim 13 wherein the display panel comprises more than one layer.

16. The lighting display of claim 15 wherein the first display panel includes an outer layer, the outer layer comprising at least a first and a second display area having a relatively high and relatively low transmissivity, respectively, and wherein the first display area is aligned with at least a portion of the decorative image and the second display area surrounds at least a portion of the decorative image.

17. The lighting display of claim 13 wherein the plurality of regions of the housing are partitioned such that, when the lighting display is activated, light emanating from one of the regions is substantially prevented from illuminating any other region.

18. The lighting display of claim 13 further comprising:

a second display panel coupled to the housing opposite the first display panel such that, when the lighting display is activated, the one or more lighting elements positioned in the first region intermittingly illuminate a first portion of the decorative image on the first display panel and a first corresponding portion of a corresponding decorative image on the second display panel and the one or more lighting elements positioned in the second region intermittingly illuminate a second portion of the decorative image on the first display panel and a second corresponding portion of the corresponding decorative image on the second display panel, the intermittent illumination of the first and second portions of the decorative image of the first display panel and the corresponding first and second portions of the corresponding decorative image of the second display panel cooperating to produce an animated visual effect on opposing sides of the housing.

19. A method for making a lighting display, comprising:

providing a housing having a plurality of distinct regions separated by one or more partitions that are at least substantially opaque, the housing including at least a first region defined by a first of the one or more partitions and a second region defined by a second of the one or more partitions, the housing having a lower surface and the one or more partitions extend from the lower surface of the housing to separate the first region from the second region, and the first and second regions partitioned such that, when the lighting display is activated, light emanating from one of the regions is substantially prevented from illuminating any other region by the one or more partitions that separate the regions;

stringing together a first group and a second group of lighting elements of a same first light string independently repositionable lighting elements together on a single strand; and positioning at least a portion of each of the first and the second group of lighting elements of the same first light string of independently repositionable lighting elements in the first and second regions, respectively, the lighting elements within each group connected to each other in series by one or more conductors to illuminate simultaneously when energized and being configured such that, when the lighting display is activated, the one or more lighting elements of the first light string contained in the first region intermittingly illuminate a first portion of the display, the first portion of the display having a first shape that corresponds to a shape of the first of the one or more partitions, and the one or more lighting elements of the same first light string contained in the second region intermittingly illuminate a second portion of the display, the second portion of the display having a second shape that corresponds to a shape of the second of the one or more partitions, to produce a dynamic visual effect.

20. The method of claim 19, further comprising:

coupling at least a portion of a third group of lighting elements that are independently repositionable and connected to each other to illuminate simultaneously when energized to a third region of the housing that is distinct from the first and second regions such that, when the display is activated, one or more lighting elements contained in the third region constantly illuminates a third portion of the display while being substantially shielded from illuminating the first or second portions of the display.

21. The method of claim 19, further comprising:

coupling a first display panel having a decorative image formed therein to the housing with a first portion of the decorative image aligned with the first region and the shape of the first of the one or more partitions, and a second portion of the image aligned with the second region and the shape of the second of the one or more partitions, such that, when the lighting display is activated, the one or more lighting elements contained in the first region intermittingly illuminate the first portion of the decorative image and the one or more lighting elements contained in the second region intermittingly illuminate the second portion of the decorative image to produce an animated visual effect.

22. The method of claim 21 wherein the display panel includes an image layer coupled to an outer layer, the image layer having at least a first area of relatively high transmissivity, containing the decorative image and having a shape that corresponds to the shape of the first of the one or more partitions, and the outer layer including at least a first display area of relatively high transmissivity aligned with a portion of the decorative image and a second display area that is substantially opaque surrounding at least a portion of the decorative image.

23. The method of claim 21, further comprising:

coupling a second display panel having a corresponding decorative image formed therein to the housing opposite the first display panel, a first corresponding portion of the corresponding decorative image aligned with the first region and a second corresponding portion of the corresponding decorative image aligned with the second region such that, when the lighting display is activated, the one or more lighting elements contained in the first region intermittingly illuminate the first portion of the decorative image and the first corresponding portion of the corresponding decorative image and the one or more lighting elements contained in the second region intermittingly illuminate the second portion of the decorative image and the second corresponding portion of the corresponding decorative image to produce an animated visual effect on opposing sides of the housing.

24. A three-dimensional decorative lighting display comprising:

a plurality of display housings coupled together to create a three-dimensional form;

a first display panel forming at least a portion of an exterior surface of the three-dimensional display, the first display panel overlying at least a portion of a first one of the display housings; and a string of lighting elements that are independently repositionable and coupled to the first one of the display housings, the string of lighting elements terminating in an electrical plug and including a first group of the lighting elements positioned within a first region of the first one of the display housings behind a first portion of the first display panel and a second group of the lighting elements of the same string positioned within a second region of the first one of the display housings behind a second portion of the first display panel separate from the first portion, each of the first and second groups of the lighting elements from the same string being configured to illuminate simultaneously when activated, wherein, the first region of the first one of the display housing being defined by at least a first partition member and the second region of the first one of the display housing being defined by at least a second partition member, the partition members are at least substantially opaque, and the first portion of the first display panel having a shape that corresponds to the first partition member and the second portion of the first display panel having a shape that corresponds to the second partition member;

wherein, the first group and the second group of lighting elements are strung together on a single strand; and wherein, when the lighting display is activated, each of the first and second groups of the lighting elements from the same string intermittingly illuminate at least a part of a decorative image formed in the first and second portions of the display panel, respectively.

25. The lighting display of claim 24 wherein the string of lighting elements includes a controller configured to illuminate the first and second groups of the lighting elements alternately.

26. The lighting display of claim 24 wherein the display panel includes an outer layer, the outer layer comprising at least a first and a second area having a relatively high and relatively low transmissivity, respectively, and wherein the first area is aligned with a first decorative image formed in the first portion of the display panel and the second area surrounds the first decorative image.

27. The lighting display of claim 24, further comprising:

a second display panel forming an opposing portion of the exterior surface of the three-dimensional display such that, when the lighting display is activated, the intermittent illumination of one or more parts of each of the first and second display panels cooperate to produce an animated visual effect on opposing sides of the display.

28. A decorative lighting display comprising:

a three-dimensional housing having an interior cavity partitioned into a plurality of compartments by one or more partition members; and a string of lighting elements that are individually repositionable coupled to the housing, the string of lighting elements terminating in an electrical plug and including at least a first group of the lighting elements and a second group of the lighting elements, the first group of the lighting elements of the string positioned within the housing in a first compartment at least partially defined by the one or more partition members and the second group of the lighting elements of the same string positioned within the housing in a second compartment at least partially defined by the one or more partition members, a first display panel coupled to the three-dimensional display housing, the first display panel being substantially flat and planar and having at least an image layer panel, the image layer panel formed from a first single plastic sheet and including a decorative image including at least a first display portion having a first shape and a second display portion having a second shape, the first shape of the first display portion corresponding to a shape of the one or more partition members defining the first compartment and the second shape of the second display portion corresponding to a shape of the one or more partition members defining the second compartment, wherein, the one or more partition members are at least substantially opaque;

wherein, the first group and the second group of lighting elements are strung together on a single strand; and wherein, when the lighting display is activated, each of the first and second groups of the lighting elements of the same string intermittingly illuminate at least a portion of the housing overlying the first and second compartments, respectively.

29. The lighting display of claim 28 wherein the string of lighting elements includes at least three groups of lighting elements positioned in the first compartment, the second compartment and a third compartment, respectfully, the lighting elements within each group being connected to each other in series by one or more conductors to illuminate simultaneously when energized, and wherein the display further comprises a controller coupled to the string, the controller configured to illuminate each of the groups of lighting elements intermittingly to produce a dynamic visual effect.

30. The lighting display of claim 28 wherein the housing includes a first shell structure and a second shell structure substantially identical to the first, the first and second shell structures coupled together to form the plurality of compartments.

31. The lighting display of claim 28 wherein the housing includes a three-dimensional shell structure coupled to a substantially flat backing member, and wherein the interior cavity of the housing is partitioned into the plurality of compartments by the one or more partition members.

32. The lighting display of claim 1 wherein, the partition members are opaque.

33. A decorative lighting display of claim 13 wherein, the partition members are opaque.

34. The method for making a lighting display of claim 19 wherein, one or more partitions are opaque.

35. The three-dimensional decorative lighting display of claim 24 wherein, the partition members are opaque.

36. The decorative lighting display of claim 28 wherein, the one or more partition members are opaque.

* * * * *